US008277016B2

(12) United States Patent
Moriyama et al.

(10) Patent No.: US 8,277,016 B2
(45) Date of Patent: Oct. 2, 2012

(54) MEDIUM TRANSPORTING APPARATUS AND RECORDING APPARATUS

(75) Inventors: Ryuji Moriyama, Matsumoto (JP); Yuichi Aruga, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 313 days.

(21) Appl. No.: 12/786,170

(22) Filed: May 24, 2010

(65) Prior Publication Data

US 2010/0302298 A1 Dec. 2, 2010

(30) Foreign Application Priority Data

May 29, 2009 (JP) ..... 2009-130667

(51) Int. Cl.
*B41J 29/38* (2006.01)
*B41J 2/01* (2006.01)
*B65H 5/22* (2006.01)

(52) U.S. Cl. ..... 347/16; 347/101; 347/104; 347/105; 271/3.14; 271/4.1

(58) Field of Classification Search ..... 347/16, 347/101–106; 271/3.14, 4.1; 400/642; 101/118
See application file for complete search history.

(56) References Cited

U.S. PATENT DOCUMENTS

2003/0127001 A1* 7/2003 Kanno ..... 101/116
2007/0030299 A1* 2/2007 Izuchi ..... 347/16

FOREIGN PATENT DOCUMENTS

JP 2006-298605 11/2006

* cited by examiner

*Primary Examiner* — Jason Uhlenhake
(74) *Attorney, Agent, or Firm* — Workman Nydegger

(57) ABSTRACT

A medium transporting apparatus has a first transport path that reverses the sides of the medium when guiding the medium, wherein the first transport path is installed so as to be connected to the middle of a second transport path between a mounting portion and a recording portion; a first mode in which after there has been recording on a first surface of a preceding medium, a second roller installed on the mounting portion transports a succeeding medium to the recording portion side while guiding it to the second transport path.

9 Claims, 14 Drawing Sheets

MEDIUM TRANSPORTING APPARATUS AND RECORDING APPARATUS

BACKGROUND

1. Technical Field

The present invention relates to a medium transporting apparatus, which is mounted on a recording apparatus main body for recording with respect to a medium to be recorded, which includes a transporting unit for transporting the medium to be recorded in a transport direction and a transport path that has the transporting unit on a path where the medium to be recorded can be reversed to its front and rear sides when guiding the medium to be recorded which is transported by the transporting unit, and a recording apparatus including the medium transporting apparatus.

In the invention, the recording apparatus includes various kinds of apparatuses such as an inkjet printer, a wire dot printer, a laser printer, a line printer, a copier, a facsimile or the like.

2. Related Art

In a related art, as described in JP-A-2006-298605, a medium transporting apparatus mounted on a recording apparatus main body includes a roller which is an example of a transporting unit and a reverse path which is a transport path. Among them, the roller is installed so as to be able to transport a paper which is an example of a medium to be recorded in a transport direction. In addition, the roller has been installed so that it can be driven by the use of the power of a motor installed in the recording apparatus main body side.

Furthermore, the reverse path has been formed in a ring shape when seen from a side thereof and installed so as to be able to guide the paper transported by the roller and reverse the paper to its front and rear sides. Thus, the medium transporting apparatus can reverse the paper, which the recording on a front surface has been completed, to its front and rear sides in the reverse path in a state where it is mounted on the recording apparatus. Furthermore, by returning the paper which has been reversed by the medium transporting apparatus to the recording apparatus main body side, the recording can be performed with respect to a rear surface of the paper in the recording apparatus main body side. That is to say, it can achieve double-sided recording. In addition, after there has been recording on a front surface of a first paper, the sides can be reversed to record on a rear surface, and subsequently, after a front surface of a second paper has been recorded, the sides can be reversed to record on a rear surface.

However, the medium transporting apparatus has a structure in which the roller is driven by the use of the power of the motor of the recording apparatus main body side. Thus, it is difficult to control the roller independently from the recording apparatus main body side. That is to say, it is difficult to independently change the driving speed of the roller. In addition, in order to make the apparatus main body as small as possible, the reverse path is installed such that the length thereof matches with the length of the maximum size of the recordable paper.

Herein, in case of a paper having a length smaller than the length of the maximum size, the distance of the paper transported in order to reverse both sides of the paper in the reverse path is the same as in case of the paper having the maximum size.

Thus, the time from when the recording to the front surface of the paper has been completed to when the recording to the rear surface of the paper is performed is increased to the extent that the length of the paper is short. Namely, to the extent that the length of the paper is short, an unnecessary movement distance is increased, therefore the time from the completion of the recording to the one surface to the start of the recording to the other surface is lengthened, thereby resulting in a large loss of the time. Furthermore, even when the length of the paper is relatively short, consequently, a so-called throughput, which is a use time from the start of the recording to the discharging per a sheet of paper, may not be improved.

SUMMARY

An advantage of some aspects of the invention is to provide a medium transporting apparatus and a recording apparatus which considers a loss of time from a recording completion to one surface of a medium to be recorded to a recording start to another surface thereof in a recording apparatus for performing double-sided recording.

A medium transporting apparatus of a first aspect of the invention is a medium transporting apparatus mounted on a recording apparatus main body that records with respect to the medium to be recorded, which includes a transporting unit that is driven by a motor and transports the medium to be recorded in a transport direction; and a first transport path that has the transporting unit on a path and reverses the sides of the medium to be recorded when guiding the medium to be recorded which is transported by the transporting unit; wherein the first transport path is installed so as to be connected to the middle of a second transport path that guides the medium to be recorded between a mounting portion for mounting the medium to be recorded in the recording apparatus main body and a recording portion for recording with respect to the medium to be recorded; the medium transporting apparatus has a first mode in which after there has been recording on a first surface of a preceding medium to be recorded by the recording portion, according to the length of the medium to be recorded; in a state in which a first roller installed in the recording portion transports the preceding medium to be recorded in reverse to the upstream side in the transport direction at the time of recording and inserts it into the first transport path, and the transporting unit holds the preceding medium to be recorded; a second roller installed on the mounting portion transports a succeeding medium to be recorded to the recording portion while guiding it to the second transport path; after there has been recording on a first surface of the succeeding medium to be recorded by the recording portion while the first roller transports the succeeding medium to be recorded, when the first roller transports the succeeding medium to be recorded in reverse to the upstream side in the transport direction at the time of recording and inserts it into the first transport path, the transporting unit retreats the preceding medium to be recorded, which is positioned in the first transport path, from a side which is opposite to the side where it was inserted into the first transport path, to the second transport path and transport it to the recording portion; after there has recording on a second surface, which is a rear surface when the first surface of the preceding medium to be recorded is a front surface, by the recording portion while the first roller transports the preceding medium to be recorded, when the first roller transports the preceding medium to be recorded to the downstream side in the transport direction at the time of recording, the transporting unit retreats the succeeding medium to be recorded, which is positioned in the first transport path, from the side which is opposite to the side where it was inserted into the first transport path, to the second transport path and transport it to the recording portion.

According to the first aspect of the invention, according to the length of the preceding medium to be recorded of which the recording on the first surface has been completed, the medium transporting apparatus moves the preceding medium to be recorded so as to retreat it to the first transport path and reverses the sides. Herein, by stopping only the transporting unit, the preceding medium to be recorded can be stopped in the first transport path. In addition, it is configured such that the recording on the first surface of the succeeding medium to be recorded is performed in the meantime. At this time, as compared to when the preceding medium to be recorded is transported to the recording portion without being stopped in the first transport path, it is possible to start the recording on the first surface the succeeding medium to be recorded at a quicker timing.

This is because the length of the first transport path is fixed, and as long as the transport speed of the transporting unit is fixed without being related to the length of the medium to be recorded, a time necessary for reversing the sides and again returning to the recording portion is constant.

Namely, in the present aspect, in a case where the length of the preceding medium to be recorded is shorter than the length of the first transport path, it is possible to reduce the time from after the recording on the first surface of the preceding medium to be recorded has been completed to when the recording on the next surface starts. In the present aspect, the next surface, which is recorded on after the recording on the first surface of the preceding medium to be recorded has been completed, is a first surface of the succeeding medium to be recorded.

In addition, when the recording on the first surface of the succeeding medium to be recorded has been completed, the succeeding medium to be recorded is moved so as to be retreated to the first transport path and the sides thereof are reversed. In addition, it is configured such that the recording on the second surface of the preceding medium to be recorded is performed in the meantime. Even at this time, similar to the above-described effect, in a case where the length of the succeeding medium to be recorded is shorter than the length of the first transport path, as compared to when the succeeding medium to be recorded is transported to the recording portion without being stopped in the first transport path, it is possible to record on the second surface of the preceding medium to be recorded at a quicker timing. In other words, in the present aspect, in the case where the length of the preceding medium to be recorded is shorter than the length of the first transport path, it is possible to reduce the time from after the recording on the first surface of the succeeding medium to be recorded has been completed to when the recording on the next surface starts. In the present aspect, the next surface, which is recorded after the recording on the first surface of the succeeding medium to be recorded has been completed, is a second surface of the succeeding medium to be recorded.

As described above, by changing the order of the surface of the medium to be recorded, it is possible to shorten a so-called throughput, which is a time from the start to the completion of recording on each sheet of the medium to be recorded. In other words, it is possible to decrease a loss of time and improve the throughput. This is effective for a case where the length of the medium to be recorded is shorter than the length of the first transport path. The shorter the length of the medium to be recorded is, the more effective it is.

In addition, in a case where the recording apparatus has a structure that discharges ink for recording, immediately after the recording on the first surface of the medium to be recorded has been completed, the medium to be recorded is moved to the first transport path. At this time, it is configured such that the recording on the first surface of the succeeding medium to be recorded is performed without instantly reversing the sides to perform the recording on the second surface. Thus, as compared to a case where after the recording on the first surface has been completed, the sides are reversed to instantly perform the recording on the second surface, it is possible to lengthen the drying time for drying the ink recorded on the first surface. As a result, there are no concerns that the semi-dried first surface is brushed by reversing the sides to instantly record the second surface, thereby deteriorating the recording picture quality. In particular, it is effective for a case of a high picture quality mode having a relatively high amount of ink discharging.

A second aspect of the invention has, in the first aspect, the apparatus has the first mode and a second mode in a switchable manner; in the second mode, after there has been recording on the first surface of the preceding medium to be recorded by the recording portion; the first roller transports the preceding medium to be recorded in reverse to the upstream side in the transport direction at the time of recording and inserts it into the first transport path, the transporting unit retreats the preceding medium to be recorded from the side, which is opposite to the side where it was inserted into the first transport path, to the second transport path and transports it to the recording portion; there is recording on the second surface of the preceding medium to be recorded by the recording portion while the first roller transports the preceding medium to be recorded, and the first roller transports the preceding medium to be recorded to the downstream side in the transport direction at the time of recording; the second roller installed on the mounting portion transports the succeeding medium to be recorded to the recording portion, while guiding it to the second transport path; after there has been recording on the first surface of the succeeding medium to be recorded by the recording portion while the first roller transports the succeeding medium to be recorded, the first roller transports the succeeding medium to be recorded in reverse to the upstream side in the transport direction at the time of recording and inserts it into the first transport path, and the transporting unit retreats the medium to be recorded from the side, which is opposite to the side where it was inserted into the first transport path, to the second transport path and transports it to the recording portion.

According to the second aspect of the invention, in addition to the same operating effects as the first aspect, it has first mode and the second mode in a switchable manner. In a case where the length of the medium to be recorded is longer than the first transport path, after the recording on the first surface of the medium to be recorded has been completed, the proceeding medium to be recorded is moved to the first transport path.

Herein, the preceding medium to be recorded is not received in the first transport path.

Thus, before there is recording on the first surface of the succeeding medium to be recorded, the sides of the preceding medium to be recorded are reversed to record on the second surface. That is to say, according to the length of the medium to be recorded, in a case where the length of the medium to be recorded is shorter than the length of the first transport path, the first mode is performed, and in a case where the length of the medium to be recorded is longer than the length of the first transport path, the second mode is performed. As a result, at the time of the first mode, the throughput can be improved.

A third aspect of the invention is, in the second aspect, the recording portion of the recording apparatus main body has a structure that discharges the ink for printing the medium to be recorded, and when the discharging amount of ink to the medium to be recorded is larger than a predetermined amount, the recording portion is switched to the first mode.

According to the third aspect, in addition to the same operating effects as the second aspect, in a case where the amount of ink discharged to the medium to be recorded is larger than a predetermined amount, the recording portion is switched to the first mode. Thus, as compared to a case where after the recording on the first surface has been completed, the sides are reversed and the recording on the second surface is performed, it is possible to lengthen the drying time for drying the ink recorded on the first surface. In a case where the ink is discharged by more than the predetermined amount, it is necessary to lengthen the drying time for drying the discharged ink, thus it is effective for this case.

A fourth aspect of the invention is such that, in any one aspect of the first to third aspects, in the first mode, when one medium to be recorded is inserted into the first transport path from the second transport path, at a timing when a front end side in the movement direction of another medium to be recorded, which is transported to the recording portion side, overlaps with a rear end side in the movement direction of the one medium to be recorded on the second transport path, the other medium to be recorded is transported.

According to the fourth aspect of the invention, in addition to the same operating effects as any one aspect of the first to third aspects, it is possible to overlap the rear end side in the movement direction of the one medium to be recorded on the second transport path with the front end side in the movement direction of another medium to be recorded. Thus, it is possible to further reduce the time from after the recording of the first surface of the medium to be recorded has been completed to when the recording on the next surface starts. That is to say, a loss of time can be minimized.

A recording apparatus of a fifth aspect of the invention is a recording apparatus including a recording portion for recording with respect to a medium to be recorded and a reverse transporting portion for reversing the sides of the medium to be recorded, the reverse transporting portion having a medium transporting apparatus of one aspect of the first four aspects.

According to the fifth aspect of the invention, the reverse transporting portion has a medium transporting apparatus of one aspect of the first four aspects. Thus, the recording apparatus can obtain the same operating effects as any one aspect of the first four aspects.

A recording apparatus of a sixth aspect of the invention includes a mounting portion for mounting a medium to be recorded; a roller that is installed on the mounting portion and transports the medium to be recorded to a downstream side in a transport direction at the time of recording; a transport roller for transporting the medium to be recorded, which has been transported by the roller, to the downstream side in the transport direction; a recording portion for recording on the medium to be recorded which has been transported by the transport roller; a discharging roller for transporting the medium to be recorded, which has been recorded on by the recording portion, to the downstream side in the transport direction; a medium guide path for guiding the medium to be recorded between the mounting portion and the recording portion; a reverse transporting portion which has the transport path that is connected to the medium guide path and reverses the sides of the medium to be recorded on the paper guide path, and the reverse transporting portion that is installed on the transport path and has a transporting unit for transporting the medium to be recorded, between the roller on the medium guide path and the transport roller; a detecting unit which is installed between the transport roller and the reverse transporting portion on the medium guide path and detects the medium to be recorded; and a controlling portion that controls the driving of the roller, the transport roller, the discharging roller and the transporting unit; wherein, after the recording portion records on a first surface of a preceding medium to be recorded, the controlling portion, according to the length of the medium to be recorded, has a first mode for controlling such that in a state in which the transport roller and the discharging roller are driven for reverse rotation to transport the preceding medium to be recorded in reverse to the upstream side in the transport direction at the time of recording and insert it into the transport path, whereby the transporting unit holds the preceding medium to be recorded; the roller is driven for forward rotation to transport a succeeding medium to be recorded to the recording portion while guiding it to the medium guide path, and while the transporting roller and the discharging roller are driven for forward rotation to transport the succeeding medium to be recorded, there is recording on the first surface of the succeeding medium to be recorded by the recording portion; thereafter, when the transporting roller and the discharging roller are driven for rearward rotation to transport the succeeding medium to be recorded in reverse to the upstream side in the transport direction at the time of recording and insert it into the transport path, the transporting roller is driven to retreat the preceding medium to be recorded, which is positioned in the transport path, from a side, which is opposite to the side where it was inserted into the transport path, to the medium guide path and transport it to the recording portion, and while the transporting roller and the discharging roller are driven for forward rotation to transport the preceding medium to be recorded, there is recording on a second surface, which is a rear surface when the first surface of the preceding medium to be recorded is a front surface, by the recording portion; and subsequently, when the discharging roller is driven for forward rotation to transport the preceding medium to be recorded to the downstream side in the transport direction at the time of recording, the transporting roller is driven to retreat the succeeding medium to be recorded, which is positioned in the transport path, from the side, which is opposite to the side where it was inserted into the transport path, to the medium guide path and transport it to the recording portion, and while the transporting roller and the discharging roller are driven for forward rotation to transport the succeeding medium to be recorded, there is recording on the second surface of the succeeding medium to be recorded by the recording portion.

According to the fifth aspect of the invention, since the recording apparatus includes the controlling portion, the same operating effects as the first aspect can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described on the basis of the accompanying drawings.

Figure 1:
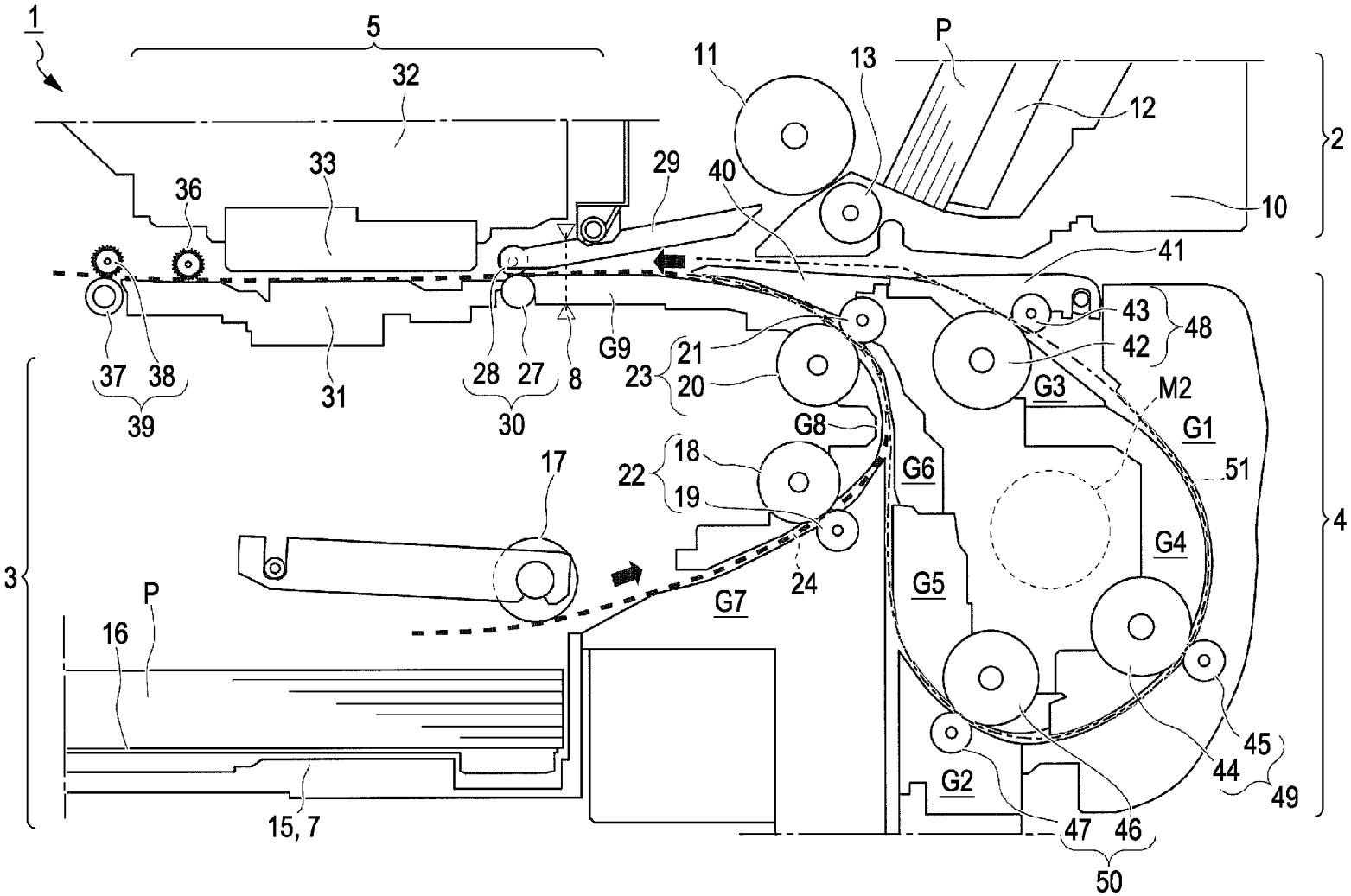
FIG. 1 is a schematic side view that shows an inner part of a printer according to an aspect of the invention.

FIG. 1 is a schematic side view that shows an outline of an inner part of an inkjet printer (hereinafter, referred to as "printer") 1 as an example of a "recording apparatus" or a "liquid jetting apparatus" according to an aspect of the invention.

Herein, the liquid ejecting apparatus is not limited to recording apparatuses such as an ink eject-type recording apparatus, a copier and a facsimile or the like which eject ink from a recording head as a liquid ejecting head to a medium to be recorded such as a recording paper to perform recording to a material to be recorded, but is used in the meaning of including an apparatus that ejects a liquid corresponding to a particular use instead of ink from a liquid ejecting head corresponding to the above-described recording head to a material to be ejected corresponding to the material to be recorded and attaches the liquid to the material to be ejected.

In addition, as the liquid jetting head, in addition to the above-described recording head, a color material jetting head which is used for manufacturing a color filter such as a liquid crystal display, an electrode material (conductive paste) jetting head which is used for forming an electrode such as an organic EL display and a face emitting display (FED), a bio organic matter jetting head which is used for manufacturing a bio chip, and a sample jetting head for jetting a sample as a micro pipette or the like may be included.

As shown in FIG. 1, the printer 1 includes a rear feeding portion 2, a front feeding portion 3, a reverse transporting portion 4, a recording portion 5, a discharging portion (not shown), and a controlling portion 6.

Among them, the rear feeding portion 2 is configured such that it can transport a paper P from the rear of the printer 1 to the recording portion 5. Specifically, the rear feeding portion 2 includes a base frame 10, a paper feeding roller 11, a first hopper 12 and a retard roller 13.

Furthermore, the first hopper 12 is installed such that the paper P is mounted thereon. The first hopper 12 is installed such that it can move toward and away from the paper feeding roller 11 in the base frame 10.

In addition, the paper feeding roller 11 is installed such that it can be driven by the power of a motor which is not shown.

Furthermore, in a state in which the first hopper 12 approaches the paper feeding roller 11, the paper feeding roller 11 can transport the uppermost paper P with respect to the paper feeding roller 11 among the papers P mounted on the first hopper 12, to the downstream side in the transport direction. Herein, the retard roller 13 is installed such that it requires a predetermined load for rotation. Thus, when a plurality of papers P is to be transported by the paper feeding roller 11, it is possible to separate the next excess papers from the uppermost paper.

In addition, the front feeding portion 3 is configured such that it can reverse the paper P from the bottom of the front of the printer 1 on a U shape when seen from a side and transport the paper P to the recording portion 5. Specifically, the front feeding portion 3 has a cassette portion 15 which is an example of a mounting portion 7, a pickup roller 17, a first feeding roller pair 22, a second feeding roller pair 23, and a paper guide path 24. Among them, the cassette portion 15 has a second hopper 16 capable of mounting the paper P thereon. The second hopper 16 is installed such that it can move toward and away from the pickup roller 17.

In addition, the pickup roller 17 is installed such that it can be driven by the power of a first motor M1 (see FIGS. 2 to 12). Thus, in a state in which the second hopper 16 approaches the pickup roller 17, the pickup roller 17 can transport the uppermost paper P with respect to the pickup roller 17, to the downstream side in the transport direction.

In addition, of course, the pickup roller 17 may be conceptually configured as a part of the mounting portion 7.

In addition, the first feeding roller pair 22 is installed such that it can further transport the paper P, which has been transported by the pickup roller 17, to the downstream side in the transport direction. Specifically, the first feeding roller pair 22 has a first feeding driving roller 18 and a first feeding driven roller 19. Among them, the first feeding driving roller 18 is installed such that it can be driven by the power of the first motor M1.

On the other hand, the first feeding driven roller 19 is installed such that it can be rotated according to the rotation of the first feeding driving roller 18.

In addition, the first feeding driving roller 18 is installed such that it can move toward and away from the first feeding driven roller 19 by means of the power of a motor for forward and backward movement (not shown).

Furthermore, a mechanism, which moves toward and away from the first feeding driven roller 19, may be configured, for example, by a planetary gear mechanism.

In addition, the second feeding roller pair 23 is installed such that it can further transport the paper P, which has been transported by the first feeding roller pair 22, to the downstream side in the transport direction. Specifically, similar to the above-described first feeding roller pair 22, the second feeding roller pair 23 has a second feeding driving roller 20 and a second feeding driven roller 21. Among them, the second feeding driving roller 20 is installed such that it can be driven by the power of the first motor M1. On the other hand, the second feeding driven roller 21 is installed such that it can be rotated according to the rotation of the second feeding driving roller 20.

In addition, the second feeding driving roller 20 is configured such that it can move toward and away from the second feeding driven roller 21 by means of the power of a motor for forward and backward movement (not shown).

In addition, the paper guide path 24 is configured such that it can guide the paper P from the mounting portion 7 to the recording portion 5. Specifically, the paper guide path 24 includes guide members G6 to G9, an upper guide member 29 and a first flap 40.

In addition, a reverse transporting portion 4 is detachably installed in the printer main body.

Herein, the printer main body refers to a portion except for the reverse transporting portion 4 in the printer 1.

In addition, the reverse transporting portion 4 is configured such that it can reverse both sides of the paper P in which one surface of the paper P in the recording portion 5 has been recorded and transport the paper P to the recording portion 5 again. Specifically, the reverse transporting portion 4 has a first reverse roller pair 48, a second reverse roller pair 49, a third reverse roller pair 50, a second motor M2, and a reverse path 51.

Among them, the first reverse roller pair 48 is installed such that it can transport the paper P, which has been reversely transported to the upstream side (a direction which is opposite to a direction of an arrow of a Y axis) in the transport direction at the time of recording from the recording portion 5, to the second reverse roller pair side in the reverse path 51. Specifically, the first reverse roller pair 48 has a first reverse roller 42 which is driven by the power of the second motor M2 and a first driven roller 43 which rotates according to the rotation of the first reverse roller 42.

In addition, the second reverse roller pair 49 is installed such that it can transport the paper P, which has been transported from the first reverse roller pair 48, to the third reverse roller pair side. Specifically, similar to the above-described first reverse roller pair 48, the second reverse roller pair 49 has a second reverse roller 44, which is driven by the power of the second motor M2, and a second driven roller 45 which rotates according to the rotation of the second reverse roller 44.

Furthermore, the third reverse roller pair 50 is installed such that it can transport the paper P which has been transported from the second reverse roller pair 49 to the recording portion side. Specifically, similar to the above-described first reverse roller pair 48, the third reverse roller pair 50 has a third reverse roller 46, which is driven by the power of the second motor M2, and a third driven roller 47 which rotates according to the rotation of the third reverse roller 46.

In addition, the reverse path 51 is formed in a ring shape when seen from the side thereof and is connected to the paper guide path 24. Specifically, the reverse path 51 is formed in a ring shape when seen from the side thereof by means of the guide members G1 to G8, the first flap 40 and the second flap 41.

In addition, the first flap 40 is installed such that it can roll by its own weight. On the other hand, the second flap 41 is installed such that it can roll by the power of a motor which is not shown.

In addition, the recording portion 5 is configured such that it can discharge the ink to the paper P to perform recording. Specifically, the recording portion 5 includes a carriage 32, a recording head 33, a bottom guide member 31 and a carriage motor which is not shown. Among them, the carriage 32 is installed such that it can move in the width direction X of the paper P by the power of the carriage motor, while being guided to a guide portion (not shown) which extends in the width direction X of the paper P. In addition, the recording head 33 is installed in the bottom side of the carriage 32 and is configured such that it can discharge the ink to the paper P. In addition, the bottom guide member 31 is installed such that it can support the paper P from the down side in a position which is opposite to the recording head 33.

In addition, in the vicinity of the upstream side in the transport direction of the recording portion 5 at the time of recording, the transport roller pair 30 is installed. The transport roller pair 30 is installed such that it can transport the paper P to the upstream side and the downstream side in the transport direction at the time of recording. Specifically, the transport roller pair 30 has a transport driving roller 27 which is driven by the power of the third motor M3 (see FIGS. 2 to 12), and the transport driven roller 28 which rotates according to the rotation of the transport driving roller 27.

In addition, in the vicinity of the downstream side in the transport direction of the recording portion 5 at the time of recording, a discharging roller pair 39 and a discharging assistant roller 36 are installed. The discharging roller pair 39 is installed such that it can transport the paper P to the upstream side and the downstream side in the transport direction at the time of recording. Specifically, the discharging roller pair 39 has a discharging driving roller 37 which is driven by the power of the third motor M3, and the discharging driven roller 38 which rotates according to the rotation of the discharging roller 37. In addition, the discharging assistant roller 36 is installed between the recording head 33 and the discharging roller pair 39 in the transport direction Y so that the paper P does not come into contact with the recording head 33.

Furthermore, the transport roller pair 30 and the discharging roller pair 39 may be conceptually configured as a part of the recording portion 5.

In addition, the discharging portion (not shown) is installed such that it can mount the paper P on which the recording has been completed. Specifically, the discharging portion has a discharging tray (not shown) that can pile up the paper P which has been discharged by the discharging roller pair 39.

In addition, the controlling portion 6 is installed such that it can control the first motor M1, the second motor M2, the third motor M3, the forward and backward movement motor, the carriage motor and the recording head 33. In addition, at the time of double-sided recording mode that performs the recording with respect to both sides of the paper P, it is configured such that the "normal transportation mode" or the "transportation time reduction mode" is performed according to the length of the paper P.

Herein, the "normal transportation mode" refers to a mode in which there is recording on the front surface of the preceding paper P1, and the sides thereof are reversed to record on the rear surface, then, similarly, there is recording on the front surface of the succeeding paper P2, and the sides thereof are reversed to record on the rear surface. On the other hand, the "transportation time reduction mode" refers to a mode in which there is recording on the front surface of the preceding paper P1, there is recording on the front surface of the succeeding paper P2 while the sides of the preceding paper P1 are reversed, there is recording on the rear surface of the preceding paper P1 while the sides of the succeeding paper P2 are reversed, and then there is recording on the rear surface of the succeeding paper P2.

In addition, in the printer 1 of an embodiment of the invention, the length of the paper of the maximum size capable of being fed is slightly shorter than the path length from the position of the sensor 8 via the reverse path 51 again back to the position of the sensor 8. In addition, the length of the paper of the minimum size capable of being feed is slightly longer than the path length from the third reverse roller pair 50 to the second feeding roller pair 23. Herein, the path length between the roller pair and the roller pair is configured such that the path length between the third reverse roller pair 50 and the second feeding roller pair 23 is the shortest.

Subsequently, the operation of the "transportation time reduction mode" of an aspect of the invention will be described.

Figure 2:
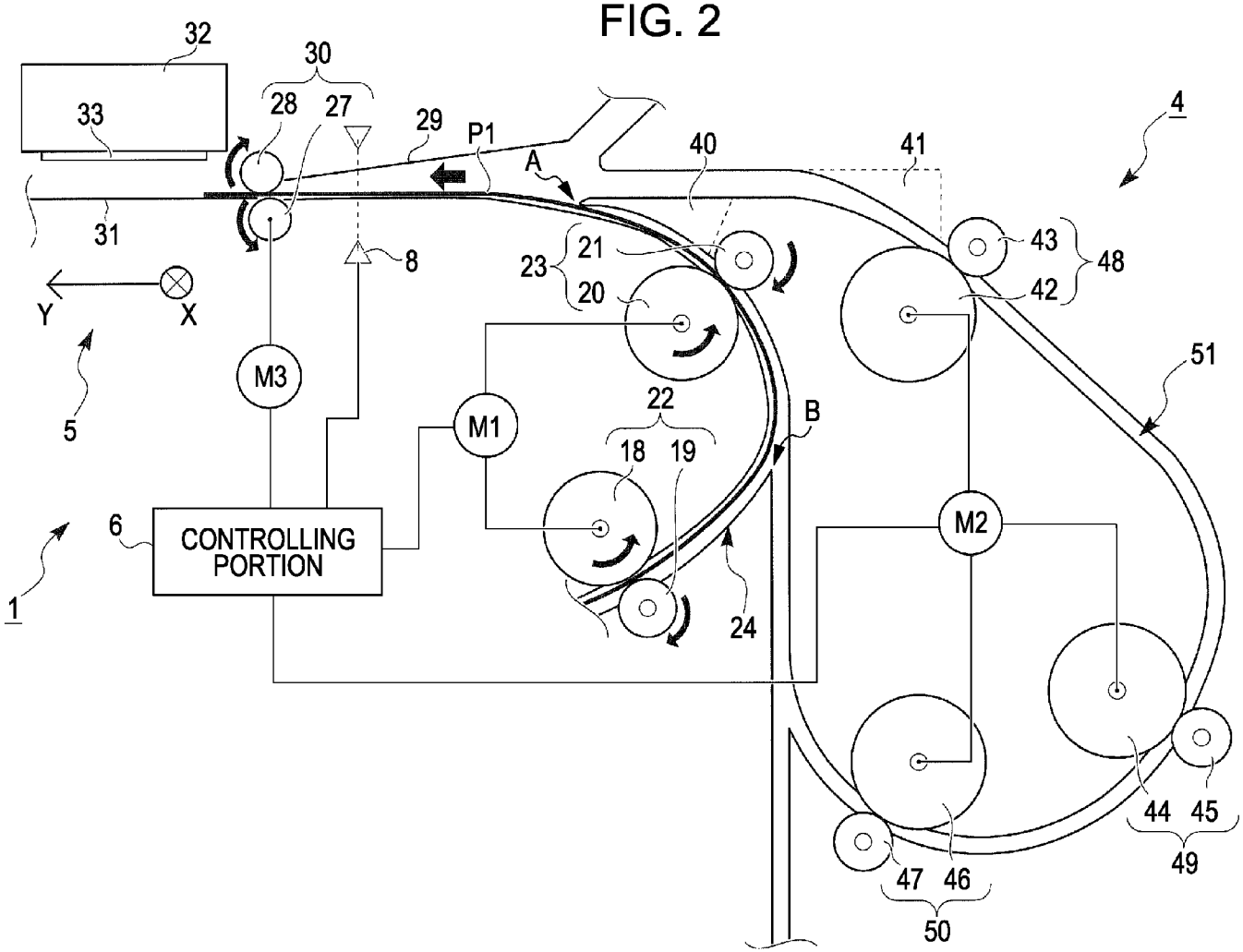
FIG. 2 is a schematic side view that shows a time when the printer according to an aspect of the invention transports a preceding paper.

FIG. 2 is a schematic side view that shows the time when the printer according to an aspect of the invention transports the preceding paper.

As shown in FIG. 2, in the upstream side in the transport direction at the time of recording from the transport driving roller 27 on the paper guide path, the sensor 8 is installed. The sensor 8 detects the front end and the rear end of the paper P and is installed such that it can send the detection signals to the controlling portion 6.

In addition, the sensor 8 may be a non-contact type sensor with a light emitting element and a light receiving element, and may be a contact type sensor in which the lever comes in contact with the paper and swings, thereby detecting the paper.

In addition, when the double recording mode is selected, the second flap 41 swings upward by means of the power of a motor (not shown). As a consequence, the reverse path 51 of a ring shape when seen from the side thereof is formed.

When the command for the recording perform is input into the controlling portion 6, the paper P mounted on the cassette portion 15 is picked up by the pickup roller 17 and is transported to the downstream side in the transport direction. The picked-up paper P is further transported to the downstream side in the transport direction by means of the first feeding roller pair 22.

In addition, when the paper P is transported to the downstream side in the transport direction, the paper P is further transported to the downstream side in the transport direction by means of the second feeding roller pair 23. Furthermore, the front end of the paper P passes through the sensor 8. At this time, the controlling portion 6 is configured such that it can receive the detection signals from the sensor 8 to recognize the front end of the paper P. Furthermore, when the paper P is transported to the downstream side in the transport direction, the front end of the paper P reaches the transport roller pair 30.

At this time, by causing the paper P to be bent between the transport roller pair 30 and the second feeding roller pair 23, the front end of the paper P is pressed in a nip line of the transport roller pair 30.

Herein, the "nip line" refers to a line-shaped circumference location that is formed by the mutual circumferences of the roller pair. The positioning of the nip line is in the vertical relationship with the transport direction.

In addition, a so-called skew adjustment is performed in which the positioning of one side of the front end side of the paper P is made to accord the positioning of the nip line of the transport roller pair 30 so as to straighten the inclined positioning of the paper P with respect to the transport direction.

In addition, the skew adjustment may be any way among a so-called "reverse rotation protruding way", "protruding way" and a "snap discharging way".

Herein, the "reverse rotation protruding way" causes the front end of the paper P to protrude into the transport roller pair 30 which is driven for the reverse rotation, thereby bending the paper P. Then the one side of the front end of the paper P is made to follow the nip line by using the force generated by the bending of the paper P, thereby performing the skew adjustment.

In addition, the "protruding way" causes the front end of the paper P to protrude into the transport roller pair 30 which is in the stopped state, thereby bending the paper P. Then the one side of the front end of the paper P is made to follow the nip line by using the force generated by the bending of the paper P, thereby performing the skew adjustment.

In addition the "snap discharging way" causes the front end of the paper P to be once pinched into the transport roller pair 30 which is driven for the forward rotation, thereby causing the snapping. Thereafter, the transport roller pair 30 is reversely transported to the upstream side so that it discharges the front end of the paper P while being driven for the reverse rotation causing the paper P to become bent. In addition, the "snap discharging way" refers to a way which makes the front end of the paper P accord to the nip line by the use of the force generated by the bending of the paper P, thereby performing the skew adjustment.

Thereafter, by means of the transport roller pair 30, the front end of the paper P is transported to a position which is opposite to the upstream side of the recording head 33 in the transport direction Y. It is a so-called a marker that transports the front end up to the recording start position. Furthermore, the paper P is recorded by the recording head 33 while being transported to the downstream side in the transport direction by means of the transport roller pair 30, the second feeding roller pair 23 and the first feeding roller pair 22. That is to say, the front surface of the paper P is recorded.

Herein, a surface to be recorded in advance in the paper P is called as the front surface. Furthermore, a surface to be recorded later is called as the rear surface.

In addition, when the paper P is transported to the downstream side in the transport direction by the transport roller pair 30, the second feeding driving roller 20 and the first feeding driving roller 18 may be each separated and moved from the second feeding driven roller 21 and the first feeding driven roller 19 by means of the power of a motor for forward and backward movement (not shown). Namely, it may be a structure in which the paper P is transported only by the transport roller pair 30. This is because it is possible to transport the paper P at a high degree of accuracy even in a related case.

Figure 3:
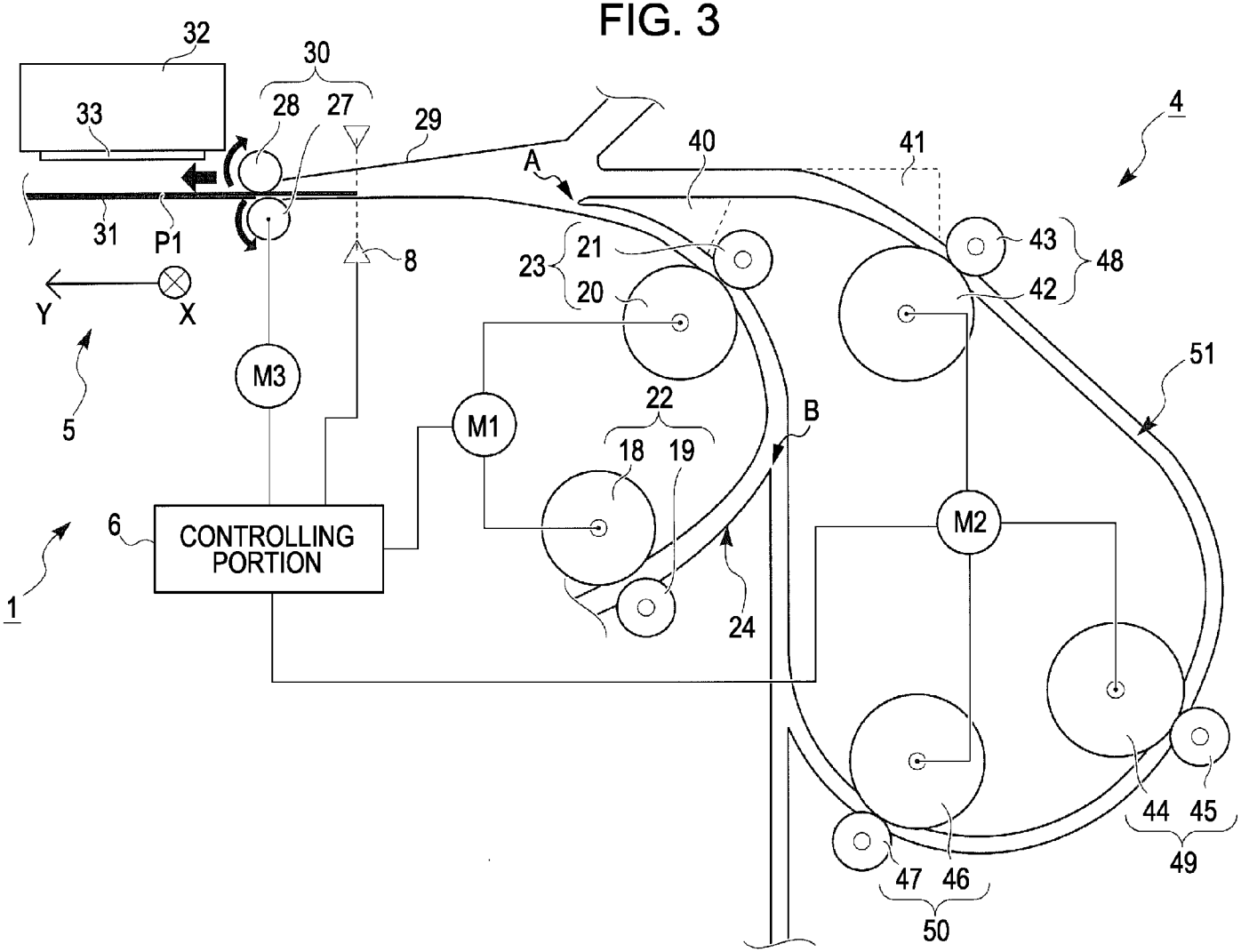
FIG. 3 is a diagram that shows a detection of the rear end of the front surface of the preceding paper of the printer according to an aspect of the invention.

FIG. 3 is a schematic side view that shows a state when the printer according to an aspect of the invention detects the rear end of the front surface of the preceding paper.

In the embodiment, the "preceding paper" refers to the papers with odd numbers when counted from the first picked-up paper in the papers which have been picked up earlier than the "succeeding paper". Specifically, they are the first paper, the third paper, and the fifth paper . . . . On the contrary, the "succeeding paper" refers to the papers with even numbers when counted from the first picked-up paper in the papers which have been picked up later than the "preceding paper." Specifically, they are the second paper, the fourth paper, and the sixth paper . . . . Namely, when the first paper is assumed to be the preceding paper, the succeeding paper is the second paper.

As shown in FIG. 3, if the preceding paper P1 is further transported from the state shown in FIG. 2 to the downstream side in the transport direction at the time of recording, the rear end of the preceding paper P1 passes through the sensor 8. The controlling portion 6 is hereby configured such that it can detect the change in signals from the sensor 8 to recognize the rear end of the paper P1. In addition, the controlling portion 6 is configured such that it can calculate the distance of the paper P transported by the second transporting roller pair and the transport roller pair 30 from when the front end of the preceding paper P1 has been detected and to when the rear end of the paper P1 is detected. This enables the length (size) of the preceding paper P1 to be identified.

In addition, in a case where the transport distance of the paper P is larger than a predetermined value, the controlling portion 6 is installed such that it can determine that the paper jamming occurs in the transport path and display an error. It is a so-called jam determining.

Figure 4:
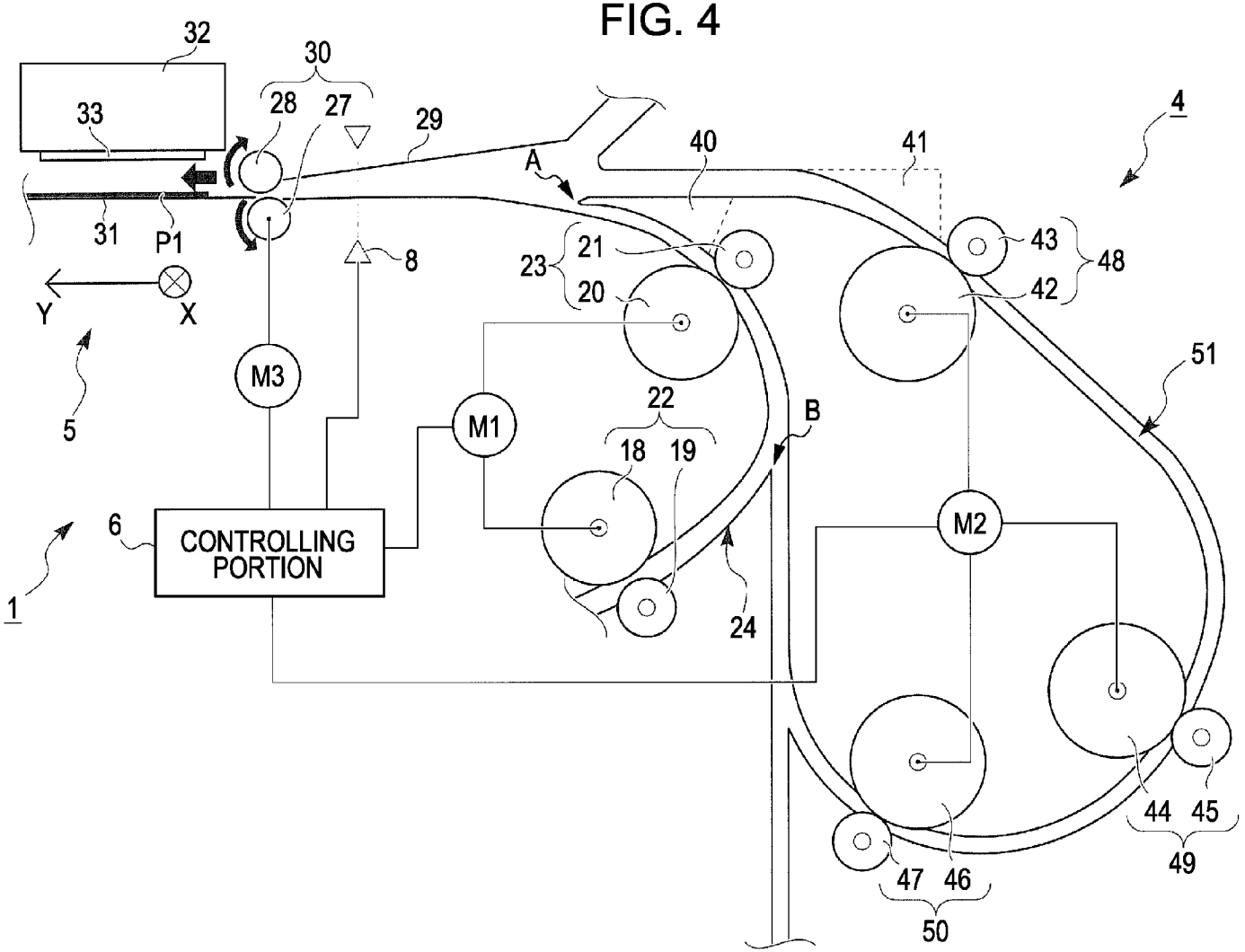
FIG. 4 is a diagram that shows the recording completion of the front surface of the preceding paper of the printer according to an aspect of the invention.

FIG. 4 is a schematic side view that shows a state when the printer according to an aspect of the invention has completed the recording on the front surface of the preceding paper.

As shown in FIG. 4, the preceding paper P1 is further transported from the state shown in FIG. 3 to the downstream side in the transport direction at the time of recording, and the recording on the rear end side in the front surface of the preceding paper P1 is completed. At this time, the rear end of the preceding paper P1 is positioned in the downstream side in the transport direction at the time of recording from the transport roller pair 30. Furthermore, the recording is completed while the preceding paper P1 is transported by the above-described discharging roller pair 39.

Herein, between when the rear end of the preceding paper P1 has been detected and when the recording on the front surface of the preceding paper P1 has been completed, the controlling portion 6 is installed so as to compare the length of the preceding paper P1 obtained by the calculation with a length from one connection point A to another connection point B with the paper guide path 24 in the reverse path 51.

In addition, of course, the information on the length of the preceding paper P1 may use information of the paper size input by the setting of the printer 1 by the user, in addition to information obtained from the above-describe calculation.

In addition, in a case where the controlling portion 6 determines that the length of the paper P is shorter than the length from the one connection point A to the other connection point B in the reverse path 51, the "transportation time reduction mode" to be described later is performed. This is for the purpose of reducing the loss of time from the recording completion to one surface to the recording start to another surface.

On the other hand, in a case where the controlling portion 6 determines that the length of the preceding paper P1 is longer than the length from the one connection point A to the other connection point B in the reverse path 51, the "normal transportation mode" is performed. This is because the preceding paper P1 cannot be completely retreated to the reverse path 51.

Herein, the "normal transportation mode" refers to a mode in which, after the recording on the front surface of the preceding paper P1 has been completed, the preceding paper P1 is transported in reverse to the upstream side in the transport direction at the time of recording on the paper, the preceding paper P1 is inserted into the reverse path 51 from the connection point A, and the sides of the preceding paper P1 are reversed and it is returned from the connection point B to the paper guide path 24, thereby performing the recording on the rear surface of the preceding paper P1 which is transported to the downstream side (an arrow direction of Y axis) in the transport direction at the time of recording. Namely, it refers to a mode in which there is recording on the front surface of the preceding paper P1, and the sides thereof are reversed to record on the rear surface, then similarly, there is recording on the front surface of the succeeding paper P2, and the surfaces thereof are reversed to record on the rear surface.

Figure 5:
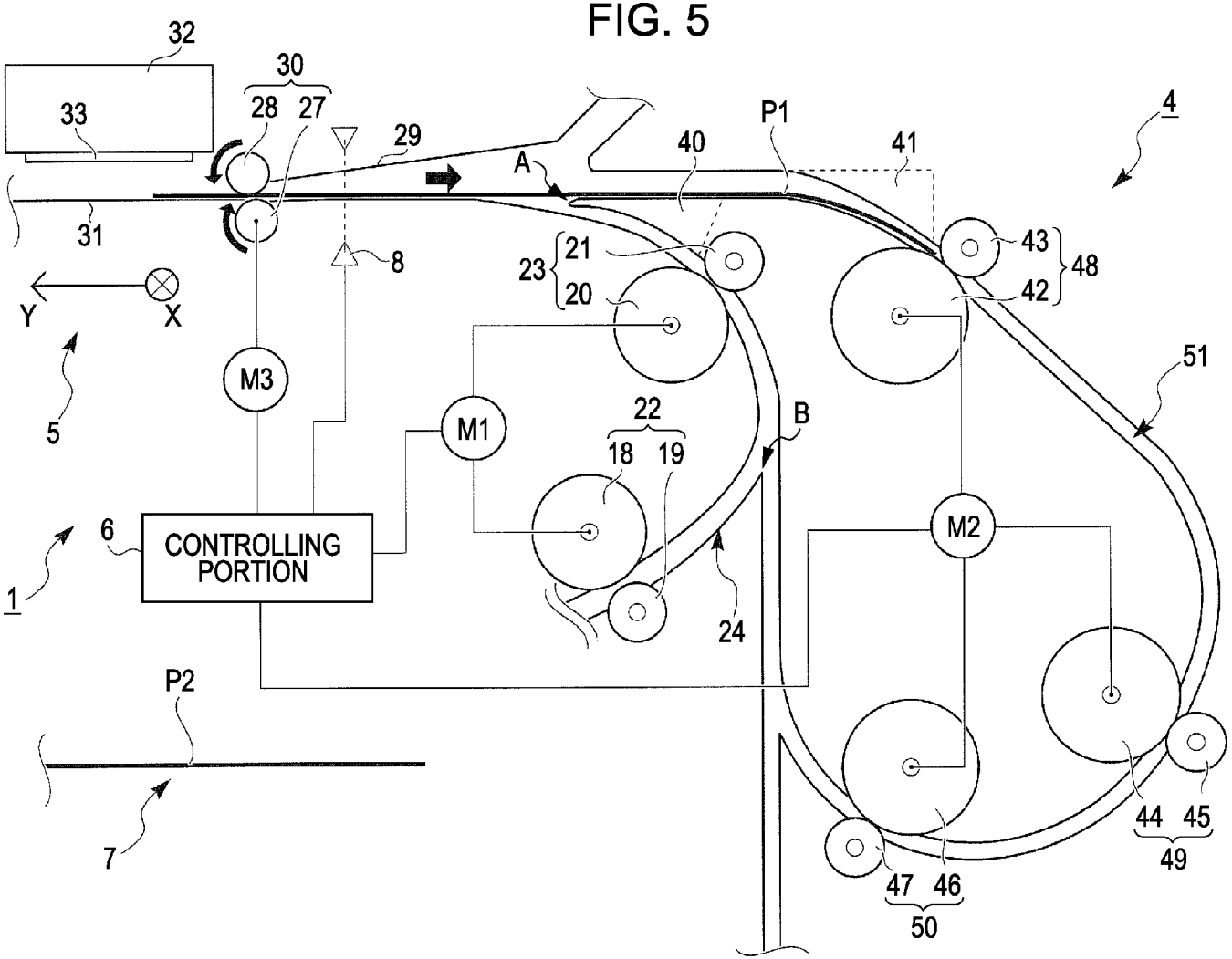
FIG. 5 is a diagram that shows the reverse transportation of the preceding paper of the printer according to an aspect of the invention.

FIG. 5 is a schematic side view that shows a state in which the printer according an aspect of the invention transports the preceding paper in reverse.

As shown in FIG. 5, in a case where the "transportation time reduction mode" is performed, the discharging roller pair 39 and the transport roller pair 30 are driven for the reverse rotation from the state shown in FIG. 4 so as to transport the preceding paper P1 in reverse to the upstream side in the transport direction at the time of recording. At this time, the first flap 40 is dropped by its own weight. Thus, the front end (an upstream end in the transport direction when there is recording on the front surface) in the movement direction of the preceding paper P1 is not guided to the second feeding roller pair in the connection point A, but is guided and inserted into the reverse path 51.

At this time, the sensor 8 detects the front end in the movement direction of the preceding paper P1. Furthermore, the timing when the succeeding paper P2 mounted on the cassette portion 15 is picked up and transported to the downstream side in the transport direction is determined from the information on the length of the preceding paper P1 obtained from the calculation. Specifically, as described hereinafter, the timing is determined such that the rear end side in the movement direction of the preceding paper P1 and the downstream end side in the transport direction of the succeeding paper P2 overlap with each other between the connection point A and the sensor 8.

Figure 6:
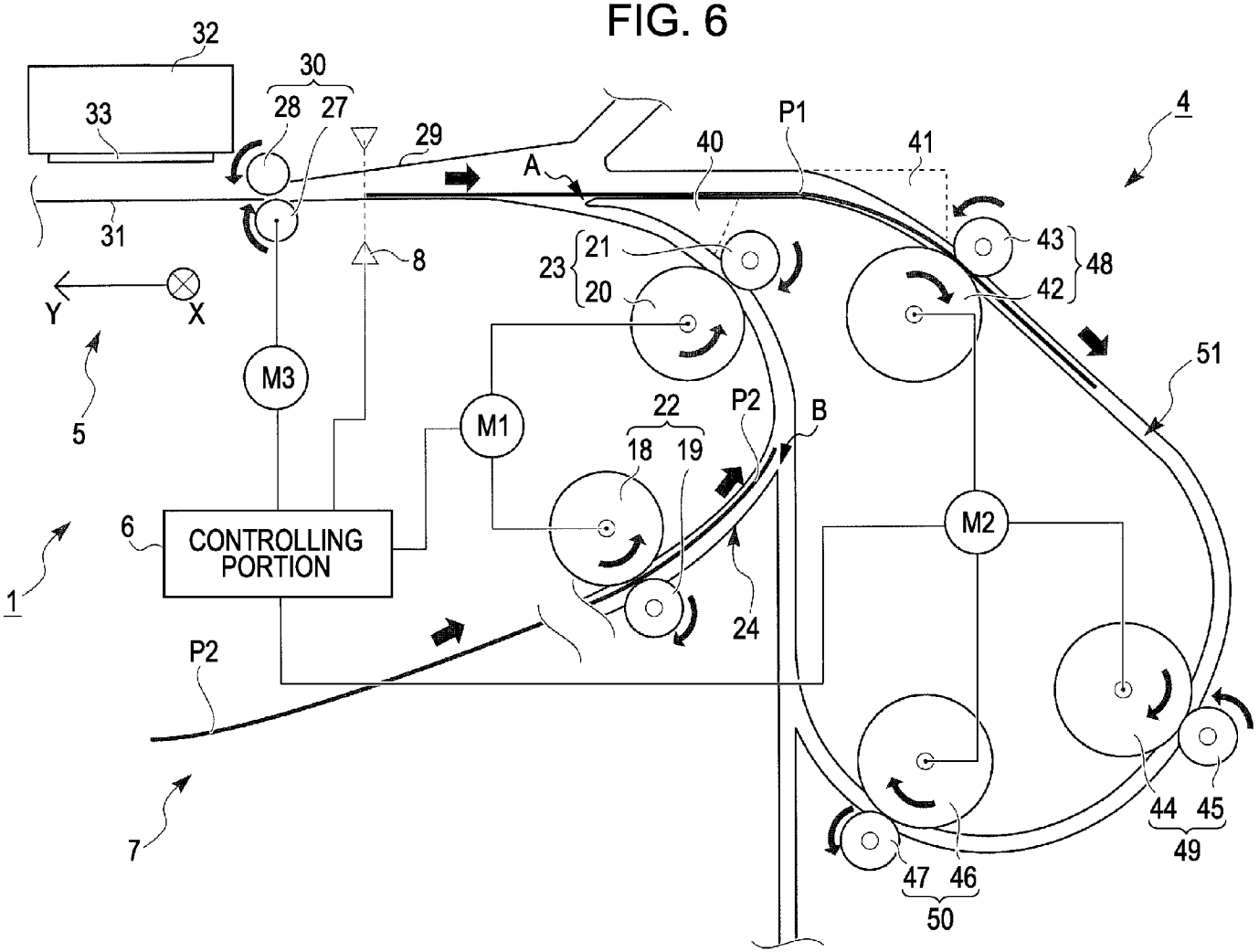
FIG. 6 is a diagram that shows a detection of a rear end in a progression direction at the time of reverse transportation of the preceding paper of the printer.

FIG. 6 is a schematic side view that shows a state in which the printer according to an aspect of the invention detects the rear end in the progression direction when the preceding paper is transported in reverse.

As shown in FIG. 6, the first reverse roller pair 48 further transports the preceding paper P1 from the state shown in FIG. 5 to the upstream side in the transport direction at the time of recording so as to retreat the preceding paper P1 from the paper guide path 24 to the reverse path 51. At this time, the sensor 8 detects the rear end in the movement direction of the preceding paper P1.

In addition, the controlling portion 6 is installed such that it can calculate the distance of the preceding paper P1 transported by the transport roller pair 30 and the first reverse roller pair 48 from when the front end of the movement direction of the preceding paper P1 has been completed and to when the rear end in the movement direction of the preceding paper P1 is detected. Namely, the controlling portion 6 is configured so as to calculate the length of the preceding paper P1 twice. The length of the preceding paper P1 can be hereby reconfirmed.

When the length of the preceding paper P1 is initially calculated, in a case where the downstream side in the transport direction at the time of recording on the preceding paper P1 protrudes from the printer 1, the user may not accurately calculate the length of the paper P1 due to an erroneous contact with the paper P1, therefore the reconfirming is preferable. In a case where the first calculated value is different from the second calculated value, it may be processed as an error. Furthermore, the "transportation time reduction mode" may be continued, by setting the second calculated value as the correct value and without processing it as an error.

In addition, the succeeding paper P2 is transported to the downstream side in the transport direction by means of the timing which is determined on the basis of the information on the length of the first calculated preceding paper P1.

In addition, in a case where the first calculated value is different from the second calculated value, it is needless to say that the timing may be corrected by using the second calculated value as the correct value. Specifically, in a case where the second calculated value is larger than the first calculated value, the timing and the speed at which the succeeding paper P2 is transported is accordingly delayed.

On the other hand, the second calculated value is small, the timing or the speed at which the succeeding paper P2 is transported is accordingly increased.

In addition, when the recording is performed while the preceding paper P1 is transported by the transport roller pair 30, in a case where the first feeding driving roller 18 is separated from the first feeding driven roller 19, of course, the first feeding driving roller 18 is caused to move toward the first feeding driven roller 19. In a related case, it is needless to say that the second feeding driving roller 20 is also caused to move toward the second feeding driven roller 21.

Figure 7:
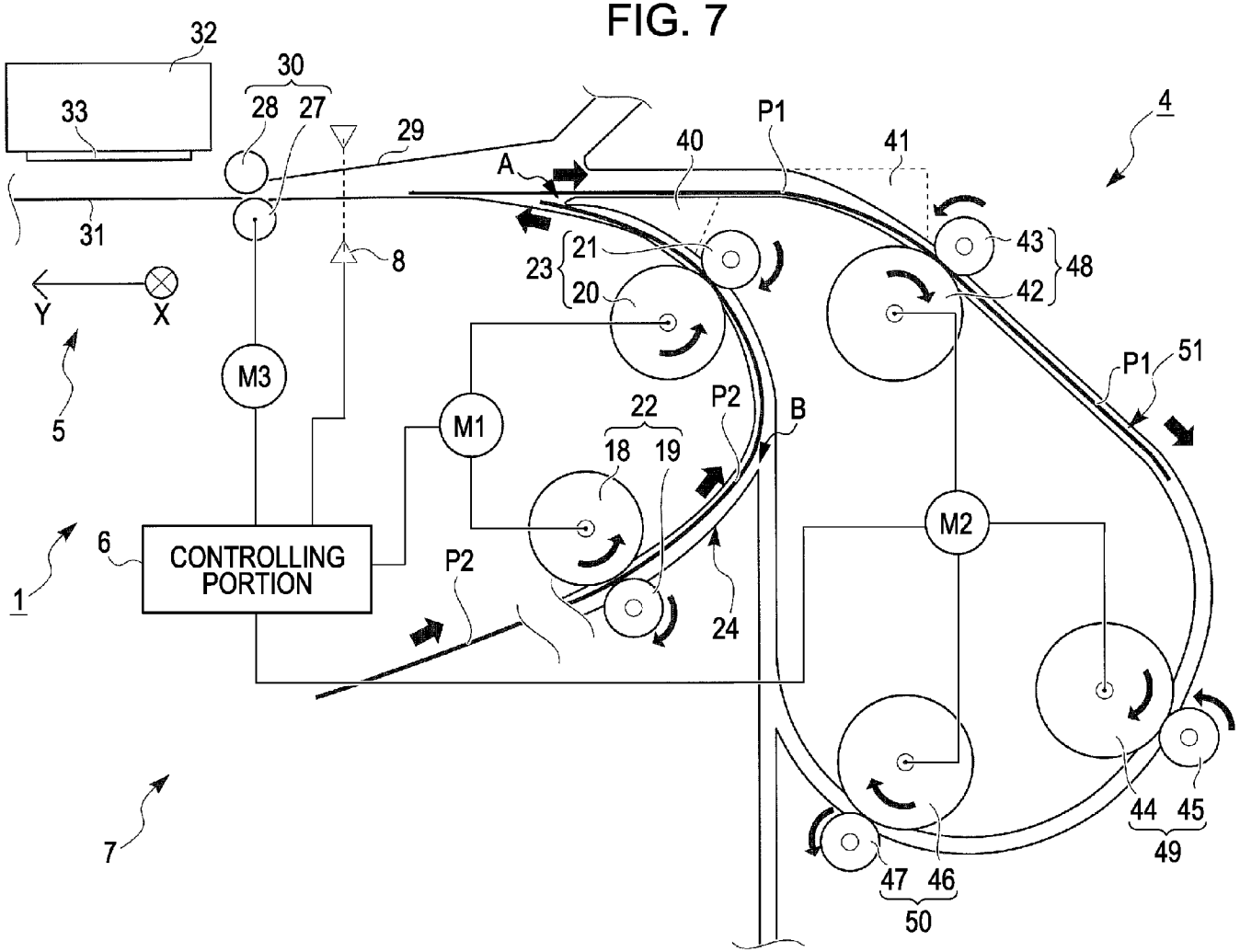
FIG. 7 is a diagram that shows a state in which a rear end of the preceding paper overlaps with a front end of a succeeding paper.

FIG. 7 is a schematic side view that shows a state in which the rear end in the movement direction of the preceding paper overlaps with the front end in the transport direction at the time of recording on the succeeding paper.

As shown in FIG. 7, when the preceding paper P1 is further transported from the state shown in FIG. 6, the paper P is transported such that it is retreated from the paper guide path 24 to the reverse path 51 by means of the first reverse roller pair 48.

On the other hand, the succeeding paper P2 is further transported to the downstream side in the transport direction by means of the first feeding roller pair 22 and the second feeding roller pair 23 at the timing determined as described above.

At this time, since the downstream end in the transport direction of the succeeding paper P2 pushes up the first flap 10 which is in a lowered state by its own weight to the extent that it does not disturb the movement of the preceding paper P1.

Thus, between the connection sensor A and the sensor 8 in the paper guide path 24, rear end side in the movement direction of the preceding paper P1 and the downstream side in the transport direction of the succeeding paper P2 can overlap with each other. As a result, the loss of time can be further reduced.

Figure 8:
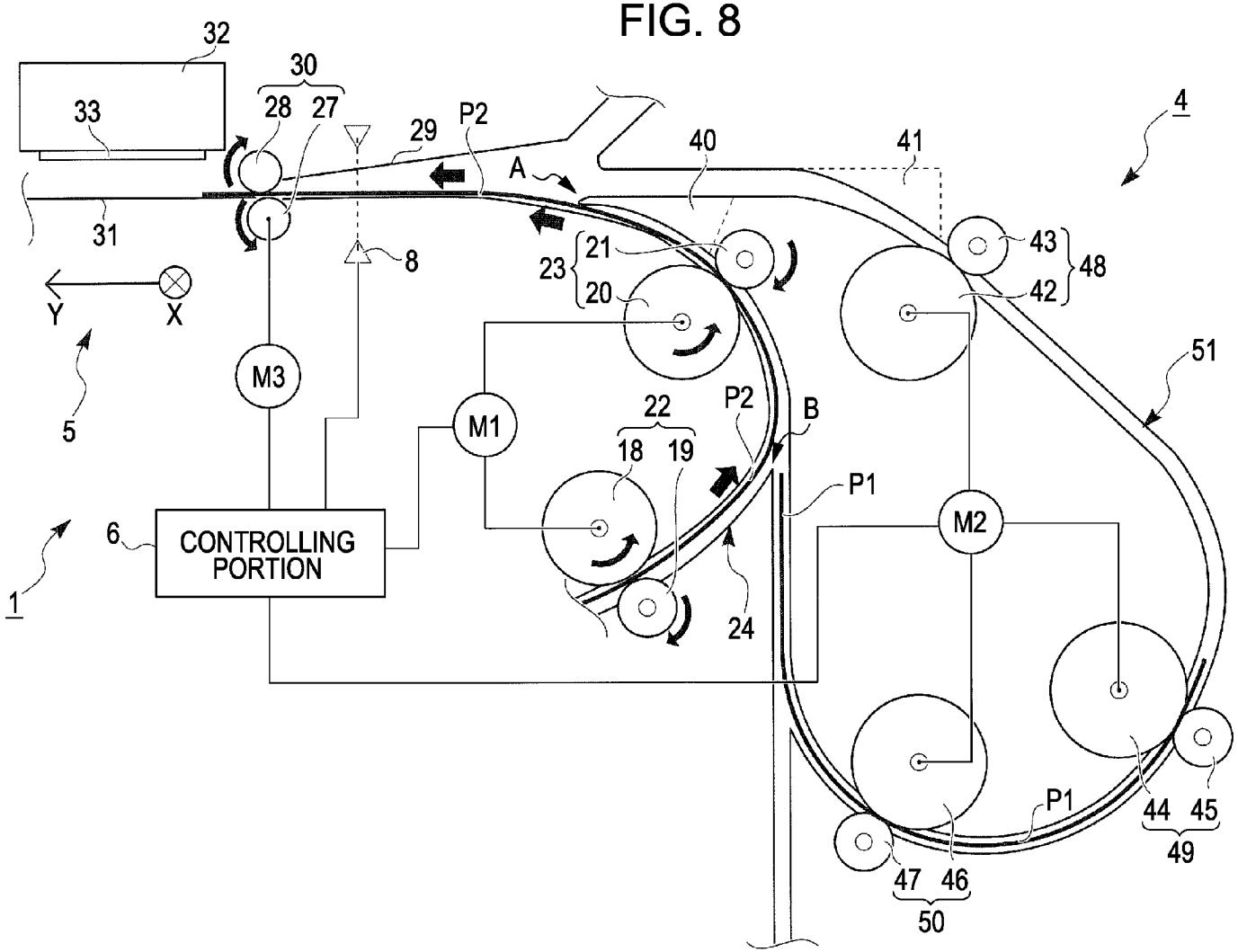
FIG. 8 is a diagram that shows a state in which the preceding paper is retreated into a reverse path and the recording on the front surface of the succeeding paper starts.

FIG. 8 is a schematic side view that shows a state in which the preceding paper is retreated into the reverse path, and the recording on the front surface of the succeeding paper starts.

As shown in FIG. 8, the preceding paper P1 is further transported from the state shown in FIG. 7 such that it is retreated from the paper guide path 24 to the reverse path 51 by the first reverse roller pair 48. Thus, the rear end side in the movement direction of the preceding paper P1 is completely retreated from the paper guide path 24 into the reverse path.

In addition, the preceding paper P1 is stopped at a predetermined position in a state of being pinched in the reverse path 51 by means of the first reverse roller pair 48, the second reverse roller pair 49 and the third reverse roller pair 50. Namely, the sides of the preceding paper P1 are reversed and are in a standby state in the reverse path.

Herein, it is preferable that the "predetermined position" be configured such that the front end in the movement direction of the preceding paper P1 is positioned at the connection point B which is opposite to the input side of the preceding paper P1 in the reverse path 51. It is possible to make the transport distance of the preceding paper P1, which is from after the standby state has been released to when the recording on the rear surface of the preceding paper P1 is performed, as short as possible. Furthermore, as described hereinafter, this is because the time from after the recording on the front surface of the succeeding paper P2 has been completed to when the recording on the front surface of the preceding paper P1 stars can be reduced to that extent.

On the other hand, the succeeding paper P2 is further transported to the downstream side in the transport direction at the time of recording by the second feeding roller pair 23. At this time, the sensor 8 detects the downstream end in the transport direction of the succeeding paper P2. Furthermore, similar to the above-described preceding paper P1, the skew adjustment is also performed with respect to the succeeding paper P2. Thereafter, the succeeding paper P2 is transported to the recording start position by the transport roller pair 30. Furthermore, the recording on the front surface of the succeeding paper P2 is performed.

Thus, in a case where double-sided recording is performed in the short paper, as compared to the "normal transportation mode", it is possible to reduce the time from after the recording on the first surface of the paper has been completed to when the recording on another surface of the paper starts.

Figure 9:
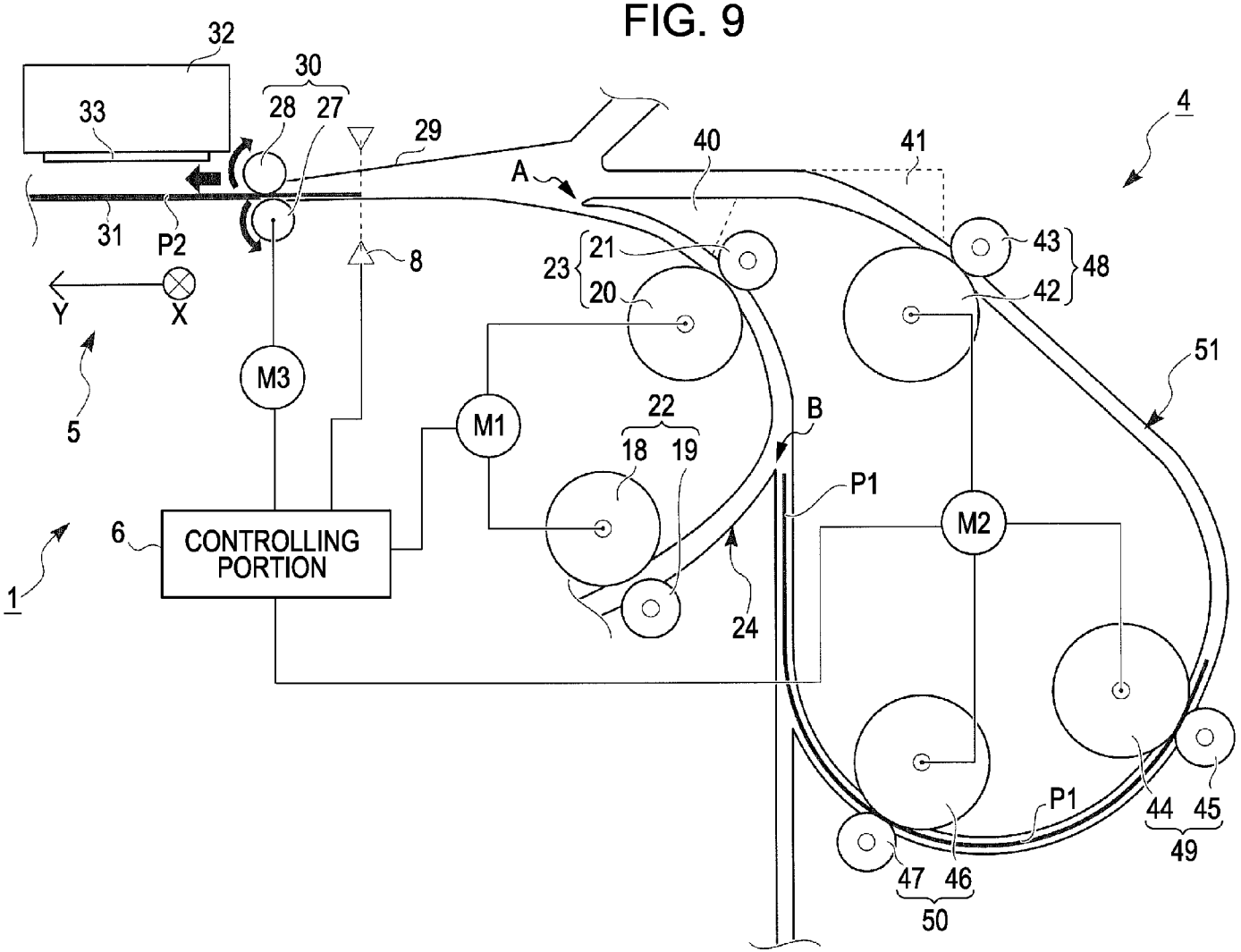
FIG. 9 is a diagram that shows the detection of a rear end of the front surface of the succeeding paper.

FIG. 9 is a schematic side view that shows a state in which the printer according to an aspect of the invention detects the upstream end in the transport direction at the time of recording on the front surface of the succeeding paper.

As shown in FIG. 9, when the succeeding paper P2 is further transported from the state shown in FIG. 8 to the downstream side of the transport direction at the time of recording, the rear end of the succeeding paper P2 passes through the sensor 8. As a result, similar to the rear end of the preceding paper P1, the controlling portion 6 can detect the change in signals from the sensor 8 to recognize the rear end of the succeeding paper P2.

Furthermore, the controlling portion 6 can calculate the length of the succeeding paper P2. In addition, the timing when the preceding paper P1, which waits in the predetermined position in the reverse path, is transported to the downstream side in the transport direction, is determined from the information on the length of the succeeding paper P2 obtained from the calculation. Specifically, as described later, the timing is determined such that the front end side in the movement direction of the preceding paper P1 and the rear end side in the movement direction of the succeeding paper P2 overlap with each other between the connection point A and the sensor 8.

On the other hand, the preceding paper P1 is in a state of waiting at the predetermined position in the reverse path.

Figure 10:
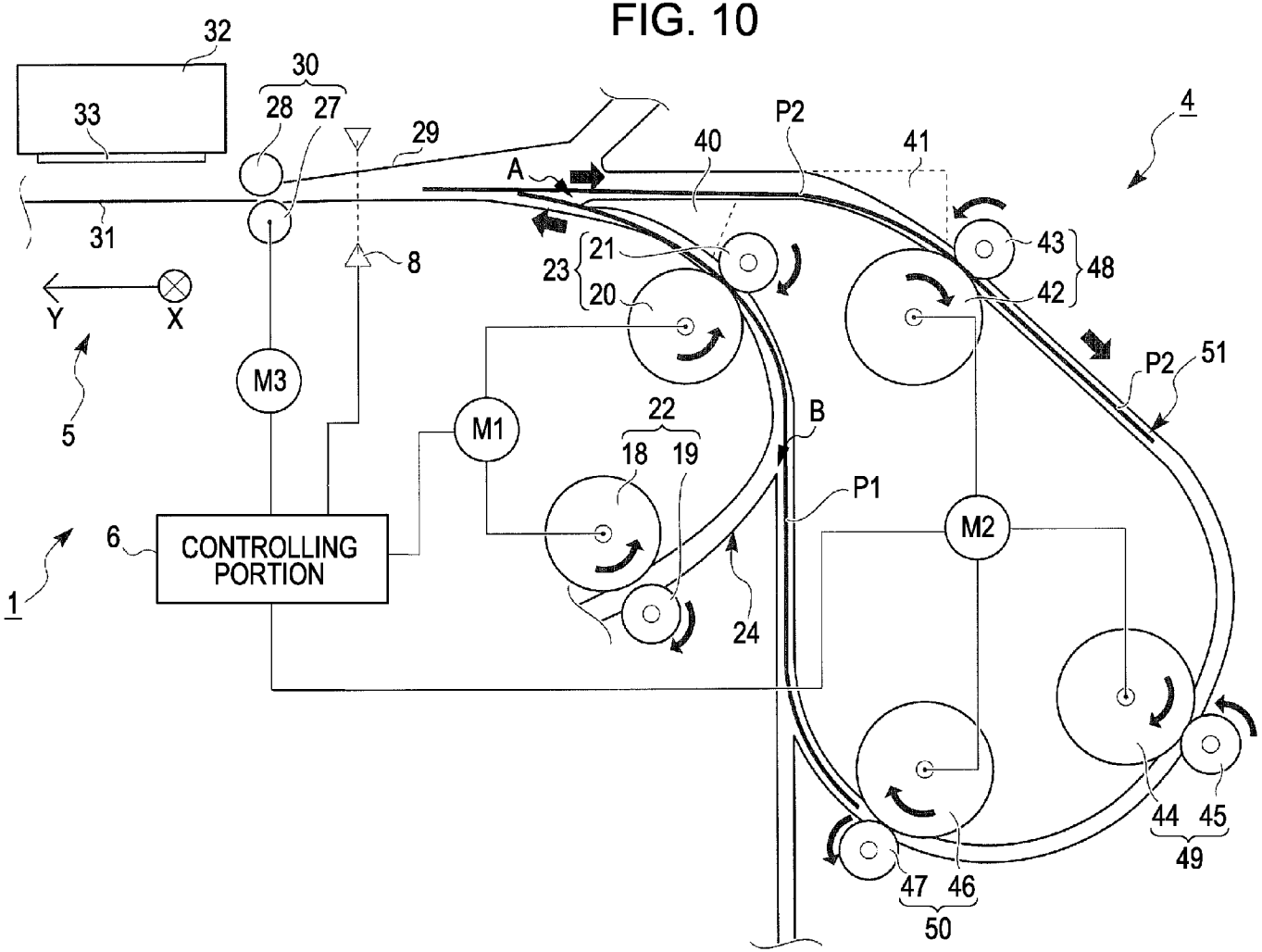
FIG. 10 is a diagram that shows the reverse transportation of the succeeding paper and the rear surface transportation of the preceding paper.

FIG. 10 is a schematic side view that shows the reverse transportation of the succeeding paper and the rear surface transportation of the preceding paper.

As shown in FIG. 10, the succeeding paper P2 is further transported from the state shown in FIG. 9 to the downstream side of the transport direction at the time of recording, and similar to when the recording on the front surface of the above-described preceding paper P1 has been completed, the recording on the front surface of the succeeding paper P2 is completed. In addition, the succeeding paper P2 is transported in reverse to the upstream side in the transport direction at the time of recording by means of the discharge roller pair 39 and the transport roller pair 30.

At this time, the first flap 40 is lowered by its own weight. Thus, the front end (upstream end in the transport direction at the time of front surface recording) in the movement direction of the succeeding paper P2 is not guided to the second feeding roller pair side in the connection point A but is guided and inserted into the reverse path 51.

At this time, the sensor 8 detects the front end in the movement direction of the succeeding paper P2. Furthermore, the succeeding paper P2 is further transported so as to be retreated from the paper guide path 24 to the reverse path 51 by the first reverse roller pair 48. At this time, the sensor 8 detects the rear end in the movement direction of the succeeding paper P2.

Furthermore, the controlling portion 6 is installed such that it can calculate the transport distance of the succeeding paper P2 by means of the transport roller pair 30 and the first reverse roller pair 48, from after the front end in the movement direction of the succeeding paper P2 has been detected to when the rear end in the movement direction of the succeeding paper P2 is detected. Namely, similar to the length of the preceding paper P1, it is configured so as to calculate the length of succeeding paper P2 twice. As a result, the length of the succeeding paper P2 can be reconfirmed. A technical meaning of reconfirming the length of the succeeding paper P2 is the same as a technical meaning of reconfirming the length of the preceding paper P1 described above.

In addition, the succeeding paper P2 is transported so as to be retreated in the reverse path, and the preceding paper P1 waiting at the predetermined position in the reverse path is transported to the downstream end in the transport direction by means of the first reverse roller pair 48 to the third reverse roller pair 50 and the second feeding roller pair 23 at the timing determined as described above. At this time, the downstream side in the transport direction of the preceding paper P1 pushes up the first flap 40 lowered by its own weight, to the extent that it does not disturb the movement of the succeeding paper P2.

Thus, between the connection point A and the sensor 8 in the paper guide path 24, the rear end side in the movement direction of the succeeding paper P2 and the downstream side in the transport direction of the preceding paper P1 can overlap with each other. As a result, the loss of time can be further reduced.

Thereafter, the preceding paper P1 is further transported to the downstream side in the transport direction at the time of recording and there is recording on the rear surface of the preceding paper P1.

On the other hand, the succeeding paper P2 is transported up to the predetermined position in the reverse path by the first reverse roller pair 48 to the third reverse roller pair 50 and is stopped. In other words, it is in the standby state in the reverse path.

In addition, when the recording is performed while the succeeding paper P2 is transported by the transport roller pair 30, in a case where the second feeding driving roller 20 is separately moved from the second feeding drive roller 21, the former may be also moved toward to the latter.

In addition, if the driving source of the second feeding driving roller 20 and the transport driving roller 27 use a common motor, by causing the second feeding driving roller 20 to move separately from the second feeding driven roller 21, it is possible to transport the preceding paper P1 to the downstream side in the transport direction by means of the first reverse roller pair 48 to the third reverse roller pair 50. This is because it is not possible that the transport driving roller 27 is driven in reverse while the second feeding driving roller is driven for forward rotation.

Figure 11:
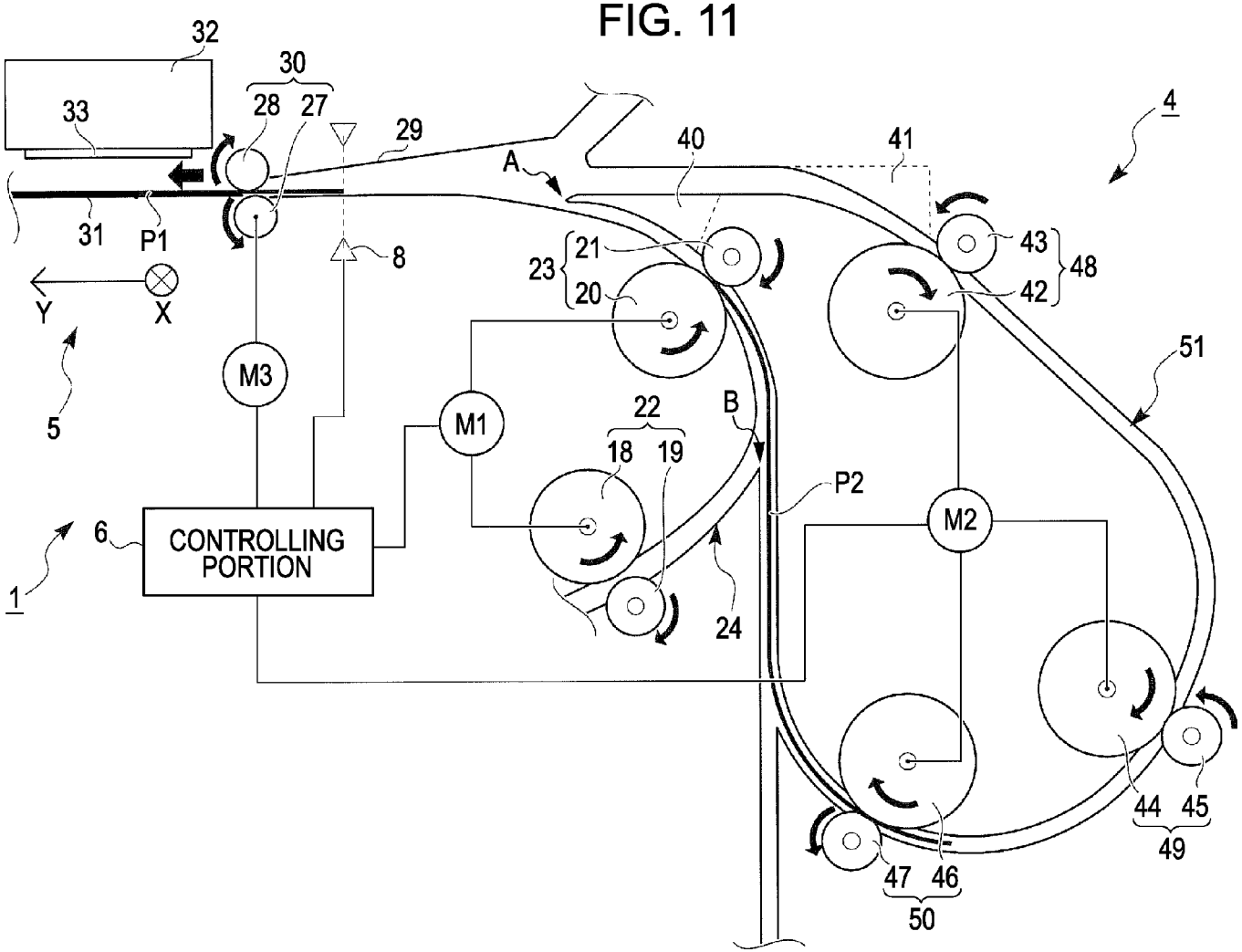
FIG. 11 is a diagram that shows the recording operation of the rear surface of the preceding paper.

FIG. 11 is a schematic side view that shows a state in which the printer according to an aspect of the invention performs the recording on the rear surface of the preceding paper.

As shown in FIG. 11, the preceding paper P1 is further transported from the state shown in FIG. 10 to the downstream side in the transport direction at the time of recording by the second feeding roller pair 23 and the transport roller pair 30, and there is recording on the rear surface of the preceding paper P1. At this time, the sensor 8 detects the downstream end and the upstream end in the transport direction of the preceding paper P1. Furthermore, when the recording on the rear surface of the preceding paper P1 has been completed, the preceding paper P1 is discharged to the discharging tray (not shown) of the printer 1 by the discharging roller pair 39.

In addition, when the downstream end in the transport direction of the preceding paper P1 is detected, the controlling portion 6 determines the timing when the waiting succeeding paper P2 in the reverse path is transported to the paper guide path 24, based on the second calculated information on the length of the preceding paper P1. Specifically, the timing is determined such that it is possible to make the distance from the upstream end in the transport direction of the preceding paper P1 to the downstream end in the transport direction of the succeeding paper P2 as short as possible. Thus, it is possible to start the recording on the rear surface of the succeeding paper P2 immediately after the recording on the rear surface of the preceding paper P1 has been completed.

On the other hand, the succeeding paper P2, which is in the waiting state in the reverse path, is transported to the downstream side in the transport direction by the first reverse roller pair 48 to the third reverse roller pair 50 and the second feeding roller pair 23 at the timing determined as described above.

Figure 12:
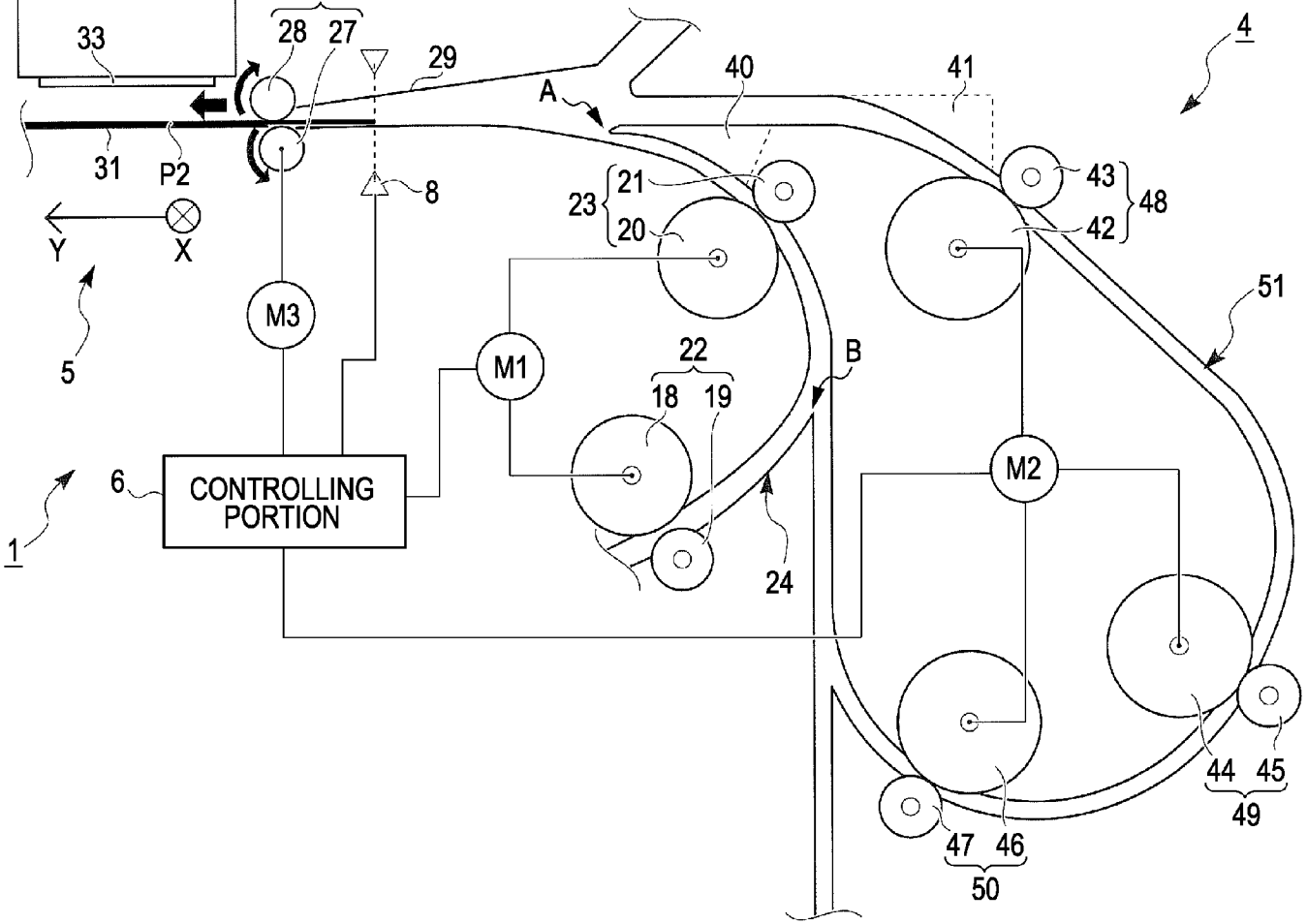
FIG. 12 is a diagram that shows the recording operation of the rear surface of the succeeding paper.

FIG. 12 is a schematic side view that shows a state in which the printer according to an aspect of the invention performs the recording on the rear surface of the succeeding paper.

As shown in FIG. 12, similar to the preceding paper P1, the succeeding paper P2 is further transported from the state shown in FIG. 11 to the downstream side in the transport direction at the time of recording by the second feeding driving roller 23 and the transfer roller pair 30. Furthermore, there is recording on the rear surface of the succeeding paper P2. At this time, the sensor 8 detects the downstream end and the upstream end in the transport direction of the succeeding paper P2. Furthermore, when the recording on the rear surface of the succeeding paper P2 has been completed, the succeeding paper P2 is discharged to the discharging tray (not shown) of the printer 1 by the discharging roller pair 39.

In addition, when the downstream end in the transport direction of the succeeding paper P2 is detected, the controlling portion 6 determines the timing when the further succeeding paper P2 mounted on the cassette portion 15 is picked up and transported to the downstream side in the transport direction, based on the second calculated information on the length of the succeeding paper P2. Specifically, the controlling portion 6 determines the timing such that it can make the distance from the upstream end in the transport direction of the succeeding paper P2 to downstream end in the transport direction of the further succeeding paper P2 as short as possible. Thus, it is possible to start the recording on the front surface of the further succeeding paper P2 immediately after the recording on the rear surface of the succeeding paper P2 has been completed.

Furthermore, as described above, similar to the order of the front surface of the preceding paper P1, the front surface of the succeeding paper P2, the rear surface of the preceding paper P1, and the rear surface of the succeeding paper P2, the further succeeding papers P2 are repeatedly recorded.

As described above, in a case where the length of the paper P is shorter than the length from the connection point A to the connection point B on the reverse path, when the double-sided recording is performed by the "transportation time reduction mode", as compared to the "normal transportation mode", it is possible to reduce the time from after the recording on the first surface of the preceding paper P1 has been completed to when the first surface of the succeeding paper P2 starts. Consequently, it is possible to reduce the so-called throughput which is the time from the start of recording to the discharging of the unit number of sheets in the double-sided recording.

In addition, since the paper P1 in which there has been recording on the front surface waits in the reverse path, as compared to a case in which the paper P1 does not wait, the ink recorded on the front surface of the paper P1 can be more securely dried. It is particularly effective in a case where the ink amount discharged to the front surface of the paper P1 is larger than the predetermined amount, so that it is difficult to relatively dry completely until the recording on the rear surface starts.

Subsequently, the double-sided recording mode including the "transportation time reduction mode" and the "normal transportation mode" will be described according to the chart diagram.

Figure 13:
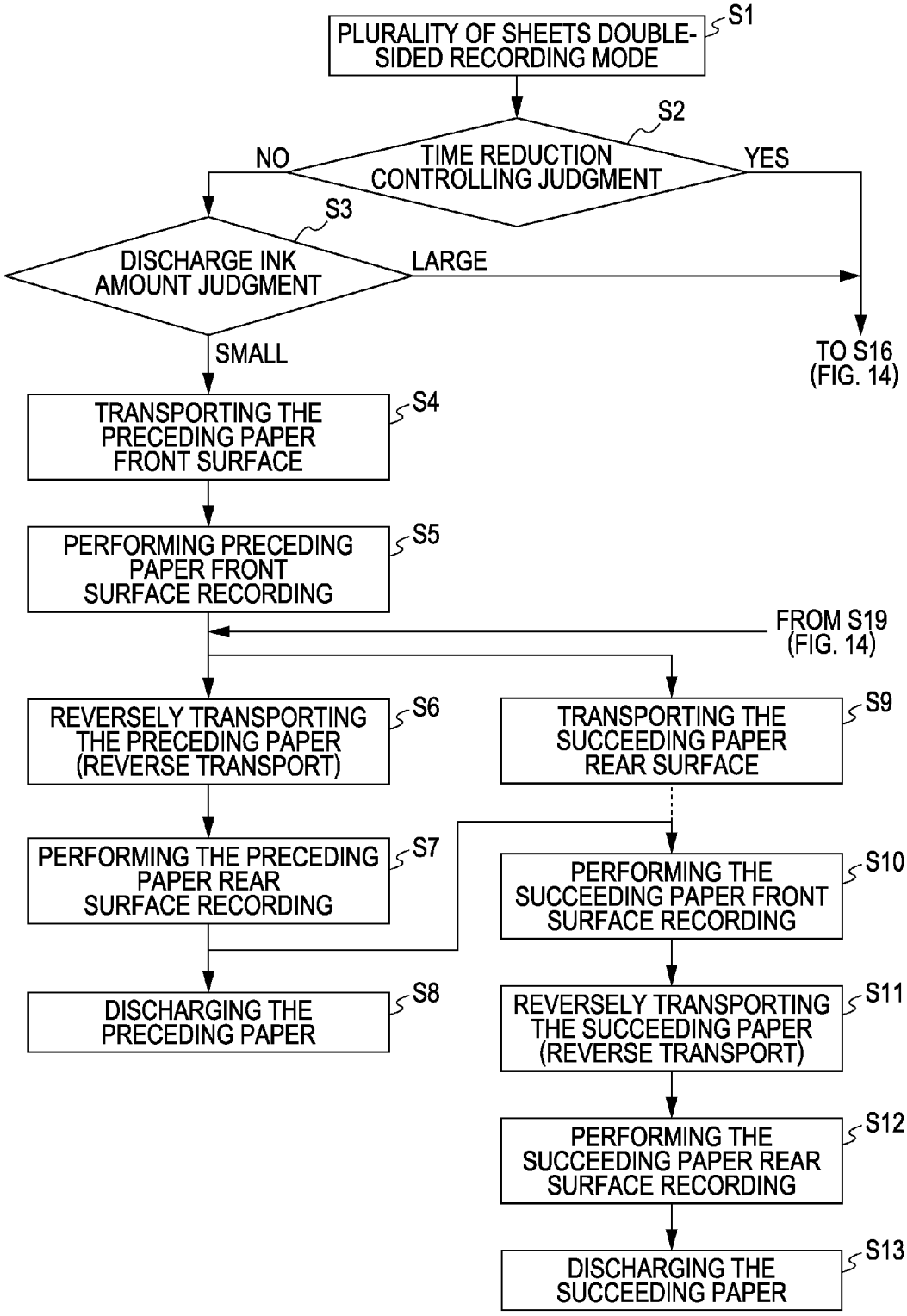
FIG. 13 is a diagram that shows the control of a transport time reduction mode and a normal transportation mode of an aspect of the invention.
Figure 14:
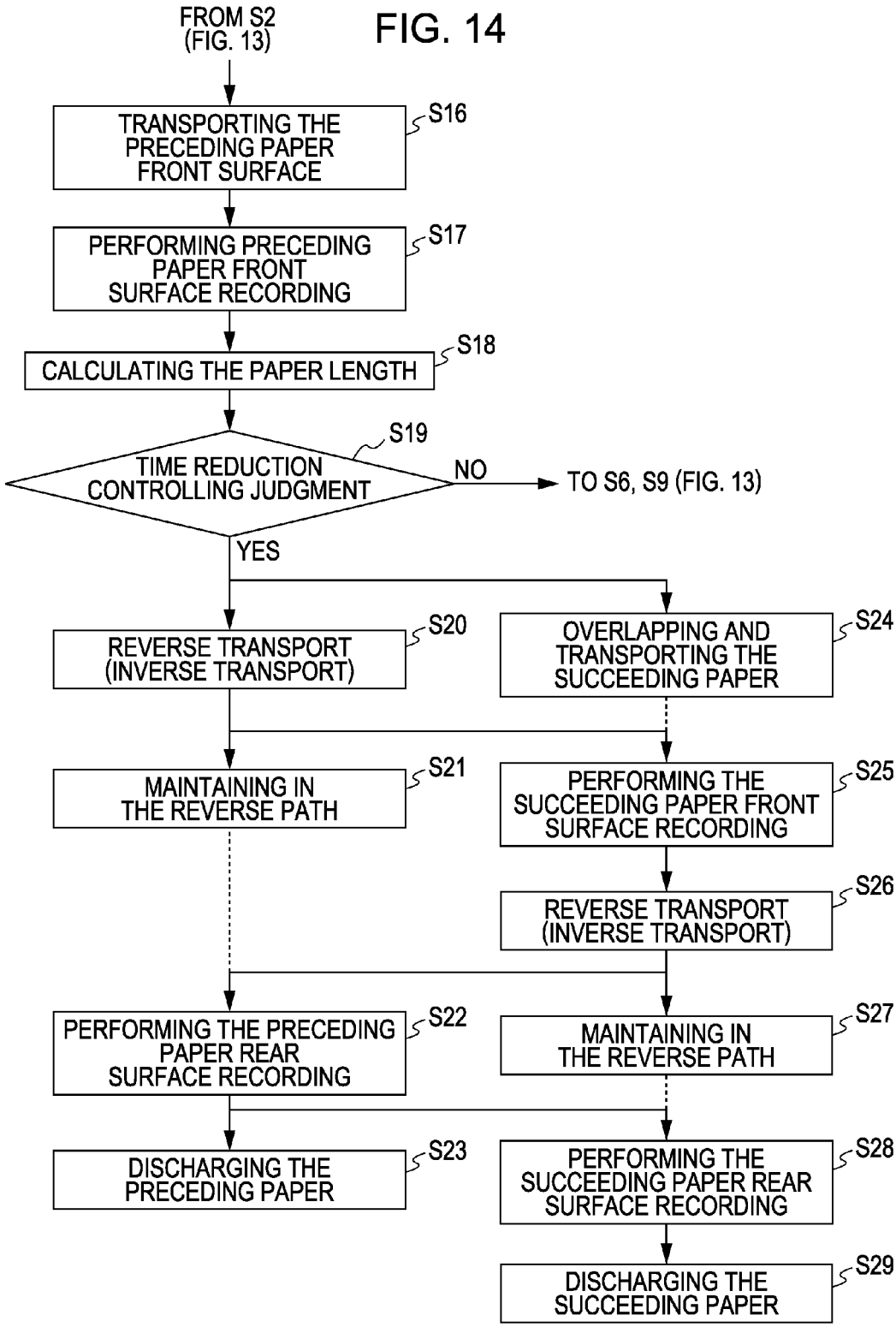
FIG. 14 is a diagram that shows the control of a transport time reduction mode and a normal transportation mode of an aspect of the invention.

FIGS. 13 and 14 are diagrams that show the control of the double-sided recording mode that includes the "transportation time reduction mode" and the "normal transportation mode" of an aspect of the invention.

As shown in FIG. 13, at step S1, the controlling portion 6 starts the plural-sheets double-sided recording mode.

Herein, the plural-sheets double-sided printing mode refers to a control mode when there is a plurality of papers P to be double-sided printed. Namely, a case where there is only one of the paper P to be double-sided printed is not included.

Furthermore, the process progresses to step S2.

At step S2, the controlling portion 6 performs the time reduction control judgment. Specifically, the user determines that the "normal transportation mode" is selected or the "transportation time reduction mode" is selected. Furthermore, in a case where it is determined that the "normal transportation mode" is selected, the process progresses to step S3. In addition, steps S3 to S13 to be described later are the "normal transportation modes".

On the other hand, in a case where it is determined that the "transportation time reduction mode" is selected, the process progresses to step S16. Furthermore, steps S16 to S30 to be described later are the "transportation time reduction modes". Among them, steps S16 to S18 and S24 are the same as the "normal transportation mode".

At step S3, the controlling portion 6 determines whether or not an average of the ink amount in which discharged per unit area is expected to be larger than the predetermined amount. Since if the average is larger than the predetermined amount, it is difficult for the ink discharged to the paper P1 to dry, it decides to perform the "transportation time reduction mode" as much as possible. On the other hand, since if the average is smaller than the predetermined amount, the problem in which it is difficult for the ink discharged to the paper P1 to dry does not occur, it decides to perform the "normal transportation mode".

Thus, in a case where it is determined that the average of the ink amount expected to be discharged is larger than the predetermined amount, the process progresses to step S16. On the other hand, in a case where it is determined that the average of the ink amount expected to be discharged is smaller than the predetermined amount, the process progresses to step S4.

At step S4, the controlling portion 6 controls such that the preceding paper P1 is transported to the downstream side in the transport direction by the pickup roller 17, the first feeding roller pair 22 and the second feeding roller pair 23. Furthermore, the process progresses to step S5.

At step S5, the controlling portion 6 controls such that there is recording on the front surface of the transported preceding paper P1. Furthermore, the process progresses to step S6 for controlling the preceding paper P1. In addition, the process progresses to step S9 for controlling the succeeding paper P2.

In addition, at this time, it is possible to determine whether or not a paper jam has occurred by calculating the length of the paper.

At step S6, the controlling portion 6 drives the discharging roller pair 39 and the transport roller pair 30 for the reverse rotation so as to transport in reverse the preceding paper P1 of which the recording on the front surface has been completed to the upstream side in the transport direction at the time of recording. In addition, the preceding paper P1 is inserted into the reverse path 51 from the connection point A, and the sides thereof are reversed in the reverse path 51 while being transported by the first reverse roller pair 48 to the third reverse roller pair 50.

In addition, at this time, it is possible to determine whether or not a paper jam has occurred by calculating the length of the paper.

In addition, the preceding paper P1 is returned from the connection point B to the paper guide path 24, while the second feeding roller pair 23 and the transport roller pair 30 are driven for the forward rotation and are transported to the downstream side in the transport direction. Furthermore, the process progresses to step S7.

At step S7, the controlling portion 6 controls such that there is recording on the rear surface of the transported preceding paper P1. Furthermore, the process progresses to step S8 for controlling the preceding paper P1. In addition, the process progresses to step S10 for controlling the succeeding paper P2.

In addition, at this time, it is possible to determine whether or not a paper jam has occurred by calculating the length of the paper.

At step S8, the controlling portion 6 controls such that the preceding paper P1 in which the recording on the rear surface thereof has been completed is discharged by the discharging roller pair 39. That is to say, the preceding paper P1 in which the recording on both sides thereof has been completed is discharged.

At step S9, the controlling portion 6 determines the timing, when the recording on the front surface of the succeeding paper P2 can be started immediately after the recording on the rear surface of the preceding paper P1 has been completed, based on the information on the length of the preceding paper P1. Specifically, the timing is determined such that the distance from the upstream end in the transport direction of the preceding paper P1, which has had its sides reversed and has been returned to the paper guide path 24 to the downstream end in the transport direction of the succeeding paper P2, can be made as short as possible.

In addition, it is controlled such that the succeeding paper P2 is transported to the downstream side in the transport direction by the pickup roller 17, the first feeding roller pair 22 and the second feeding roller pair 23 at the above-described determined timing. Then, the process progresses to step S10.

Furthermore, the succeeding paper P2 may be started to be transported at a quicker timing, and the succeeding paper P2 may wait in the paper guide path, until the recording on the rear surface of the preceding paper P1 has been completed.

Similar to the above-described step S4, at step S10, the controlling portion 6 controls such that there is recording on the front surface of the transported succeeding paper P2. Furthermore, the process progresses to step S11.

In addition, at this time, it is possible to determine whether or not a paper jam has occurred by calculating the length of the paper.

At step S11, similar to step S6 described above, the succeeding paper P2 of which the recording on the front surface has been completed is transported in reverse to the upstream side in the transport direction at the time of recording. Furthermore, the succeeding paper P2 is inserted into the reverse path 51 from the connection point A and the sides thereof are reversed in the reverse path 51.

In addition, at this time, it is possible to determine whether or not a paper jam has occurred by calculating the length of the paper.

In addition, the succeeding paper P2 is returned from the connection point B to the paper guide path 24, while the second feeding roller pair 23 and the transport roller pair 30 are driven for the forward rotation and are transported to the downstream side in the transport direction. Furthermore, the process progresses to step S12.

Similar to the above-described step S7, at step S12, the controlling portion 6 controls such that there is recording on the rear surface of the transported succeeding paper P2. Furthermore, the process progresses to step S13.

In addition, at this time, it is possible to determine whether or not a paper jam has occurred by calculating the length of the paper.

At step S13, similar to step S8 described above, the controlling portion 6 controls such that the succeeding paper P2 of which the rear surface thereof has been completed is discharged by the discharging roller pair 39.

As described above, in the "normal transportation mode", there is recording on the front surface of the preceding paper P1, and the sides thereof are reversed to record on the rear surface. Thereafter, it is controlled such that the front surface of the succeeding paper P2 is similarly recorded and the sides are reversed to record on the rear surface.

At step S16, similar to step S4 described above, the controlling portion 6 controls such that the preceding paper P1 is transported to the downstream side in the transport direction by means of the pickup roller 17, the first feeding roller pair 22 and the second feeding roller pair 23 (see FIG. 2). In addition, the process progresses to step S17.

At step S17, similar to step S5 described above, the controlling portion 6 controls such that there is recording on the front surface of the transported preceding paper P1 (FIGS. 3 and 4). Furthermore, the process progresses to step S18.

In addition, at this time, it is possible to determine whether or not a paper jam has occurred by calculating the length of the paper.

At step S18, the controlling portion 6 calculates the length of the paper P1 from information from the sensor 8 and the transport distance of the paper P1. It is for the purpose of determining whether or not the "transportation time reduction mode" can be selected. In addition, the process progresses to step S19.

At step S19, the controlling portion 6 determines whether or not the "transportation time reduction mode" can be selected. Specifically, it is determined whether or not the length of the calculated paper P1 is shorter than the length of the reverse path 51. This is for the purpose of determining whether or not the paper P1 can be retreated from the paper guide path 24 into the reverse path.

In the present embodiment, it is determined whether or not the length of the calculated paper P1 is shorter than the length from the connection point A to the connection point B in the reverse path 51. In addition, when it is determined to be shorter, in order to continuously perform the "transportation time reduction mode", the process progresses to step S20 for controlling the preceding paper P1. Furthermore, the process progress to step S24 for controlling the succeeding paper P2.

On the other hand, when it is determined to be larger, the process progresses to steps S6 and S9 for switching to the "normal transportation mode." In a related case, it is because the preceding paper P1 cannot be completely retreated into the reverse path.

At step S20, similar to the above-described step S6, the controlling portion 6 drives the discharging roller pair 39 and the transport roller pair 30 for the reverse rotation, so as to transport in reverse the preceding paper P1 of which the recording on the front surface thereof has been completed to the upstream side in the transport direction at the time of recording (see FIGS. 5 to 7). In addition, the preceding paper P1 is inserted into the reverse path 51 from the connection point A, and the sides thereof are reversed in the reverse path 51 while being transported by the first reverse roller pair 48 to the third reverse roller pair 50.

In addition, at this time, it is possible to determine whether or not a paper jam has occurred by calculating the length of the paper.

Furthermore, the process progresses to step S21 for controlling the preceding paper P1. In addition, the process progresses to step S25 for controlling the succeeding paper P2.

At step S21, the controlling portion 6 stops the preceding paper P1 at the above-described predetermined position in the reverse path and makes it in the standby state (see FIGS. 8 and 9). As described above, it is for the purpose of first performing the recording on the front surface of the succeeding paper P2. At this time, it is possible to securely dry the ink recorded on the front surface of the preceding paper P1. In the structure in which the printer 1 discharges the ink, it is particularly efficient for a high picture quality mode that discharges a relatively large quantity of ink. Furthermore, the process progresses to step S22.

At step S22, the controlling portion 6 returns the preceding paper P1, which waits at the predetermined position in the reverse path, from the connection point B to the paper guide path 24, and drives the second feeding roller pair 23 and the transport roller pair 30 for the forward rotation and transports them to the downstream side in the transport direction (see FIG. 10). In addition, the controlling portion 6 controls such that there is recording on the rear surface of the preceding paper P1 (see FIG. 11).

In addition, at this time, it is possible to determine whether or not a paper jam has occurred by calculating the length of the paper.

Furthermore, the process progresses to step S23 for controlling the preceding paper P1. In addition, the process progresses to step S28 for controlling the succeeding paper P2.

At step S23, similar to the above-described step S8, the controlling portion 6 controls such that the preceding paper P1 of which the recording on the rear surface has been completed is discharged by the discharging roller pair 39.

At step S24, the controlling portion 6 determines the timing when the succeeding paper P2 mounted on the cassette portion 15 is picked up and transported to the downstream side in the transport direction from the information on the length of the paper P1 obtained from the calculation.

Specifically, the timing is determined such that the rear end side in the movement direction of the preceding paper P1 and the downstream end side in the transport direction of the succeeding paper P2 overlap with each other between the connection point A and the sensor 8. Furthermore, the succeeding paper P2 is transported to the downstream side in the transport direction at the timing (see FIGS. 6 and 7). Furthermore, the process progresses to step S25.

At step S25, the controlling portion 6 controls such that there is recording on the front surface of the succeeding paper P2 (FIGS. 8 and 9). Furthermore, the process progresses to step S26.

In addition, at this time, it is possible to determine whether or not a paper jam has occurred by calculating the length of the paper.

At step S26, similar to the above-described step S20, the controlling portion 6 drives the discharging roller pair 39 and the transport roller pair 30 for the reverse rotation to transport in reverse the succeeding paper P2 of which the recording on the front surface has been completed to the upstream side in the transport direction at the time of recording.

Furthermore, the succeeding paper P2 is inserted into the reverse path 51 from the connection point A and the sides thereof are reversed in the reverse path 51 while being transported by the first reverse roller pair 48 to the third reverse roller pair 50 (see FIG. 10).

In addition, at this time, it is possible to determine whether or not a paper jam has occurred by calculating the length of the paper.

Furthermore, the process progresses to step S22 for controlling the preceding paper P1. In addition, the process progresses to step S27 for controlling the succeeding paper P2.

At step S27, similar to the above-described step S21, the controlling portion 6 stops the succeeding paper P2 at the above-described predetermined position in the reverse path and puts it in the standby state. As described above, it is for the purpose of first performing the recording on the rear surface of the preceding paper P1. At this time, similar to the front surface of the preceding paper P1, it is possible to securely dry the ink recorded on the front surface of the succeeding paper P2. Furthermore, the process progresses to step S28.

At step S28, similar to the above-described step S22, the controlling portion 6 returns the succeeding paper P2, which waits at the predetermined position in the reverse path, from the connection point B to the paper guide path 24, and drives the second feeding roller pair 23 and the transport roller pair 30 for the forward rotation and transports them to the downstream side in the transport direction (see FIG. 11). In addition, the controlling portion 6 controls such that there is recording on the rear surface of the succeeding paper P2 (see FIG. 12). Furthermore, the process progresses to step S29.

In addition, at this time, it is possible to determine whether or not a paper jam has occurred by calculating the length of the paper.

At step S29, similar to the above-described step S23, the controlling portion 6 controls such that the succeeding paper P2 of which the recording on the rear surface has been completed is discharged by the discharging roller pair 39.

As described above, in a case where the length of the paper P1 is shorter than the length from the connection point A to the connection point B on the reverse path, when double-sided printing is performed by means of the "transportation time reduction mode", as compared to the "normal transportation mode", it is possible to reduce the time after one surface (the front surface of the preceding paper, the front surface of the succeeding paper and the rear surface of the preceding paper) of the paper P has been completed to when the recording on another surface (the front surface of the succeeding paper, the rear surface of the preceding paper and the rear surface of the succeeding paper) of the paper P starts. In other words, the loss of time can be reduced. As a result, in double-sided recording, it is possible to reduce the so-called throughput which is the time from the start of recording to the discharge of the unit number of sheets.

In addition, since the paper P1 with the front surface recorded waits in the reverse path, as compared to a non-waiting case, the ink recorded on the front surface of the paper P1 can be more securely dried. It is particularly effective for a case where the ink amount discharged to the front surface of the paper P1 is larger than the predetermined amount and it is difficult to be relatively dried completely until the recording on the rear surface starts. This is also true for the paper P2 with the front surface recorded.

The reverse transporting portion 4 as the medium transporting apparatus of the embodiment is the reverse transporting portion 4 mounted on the printer main body as the recording apparatus main body for recording on the paper P that is an example of the medium to be recorded, which includes the first reverse roller pair 48 to the third reverse roller pair 50 as the transporting units that are driven by the second motor M2 and transport the paper P in the transport direction, and the reverse path 51 as the first transport path that has the first reverse roller pair 48 to the third reverse roller pair 50 on the path and reverses the paper P to its front and rear sides when guiding the paper P transported by the first reverse roller pair 48 to the third reverse roller pair 50. The reverse path 51 is installed so as to be connected to the middle of the paper guide path 24 as the second transport path that guides the paper P between the mounting portion 7 for mounting the paper P in the printer main body and the recording portion 5 for recording on the paper P. The reverse transporting portion has the "transportation time reduction mode" as the first mode in which after there has been recording on the front surface as the first surface of the preceding paper P1 by the recording portion 5, according to the length of the paper P1, in a state in which the transport roller pair 30 and the discharging roller pair 39 as the first roller installed in the recording portion 5 transport the preceding paper P1 in reverse to the upstream side (direction opposite to the arrow direction of the Y axis) in the transport direction at the time of recording and insert the paper P1 into the reverse path 51, and the first reverse roller pair 48 to the third reverse roller pair 50 hold the preceding paper P1; the pickup roller 17 as the second roller installed on the mounting portion 7 transports the succeeding paper P2 to the recording portion while guiding it to the paper guide path 24; after there has been recording on the front surface of the succeeding paper P2 by the recording portion 5 while the transport roller pair 30 and the discharging roller pair 39 transport the succeeding paper P2, when the transport roller pair 30 and the discharging roller pair 39 transport the succeeding paper P2 in reverse to the upstream side in the transport direction at the time of recording and insert the paper P2 into the reverse path 51, the first reverse roller pair 48 to the third reverse roller pair 50 retreat the preceding paper P1 positioned in the reverse path 51 from the retreated side connection point B opposite to the connection point A, which is the side where it was inserted into the reverse path 51, to the paper guide path 24 and transport the paper P1 to the recording portion; and after the rear surface when the first surface of the preceding paper P1 is assumed to be the front surface has been recorded on by the recording portion 5 while the transport roller pair 30 and the discharging roller pair 39 transport the preceding paper P1, when the discharging roller pair 39 transports the preceding paper P1 to the downstream side in the transport direction at the time of recording, the first reverse roller pair 48 to the third reverse roller pair 50 retreat the succeeding paper P2 positioned in the reverse path 51 from the connection point B, which is opposite to the side where it was inserted into the reverse path 51, to the paper guide path 24 and transport the paper P2 to the recording portion.

In addition, in the embodiment, the apparatus has the "transport time reduction mode" as the first mode and the "normal transportation mode" as the second mode in a switchable manner, in the "normal transportation mode", after there has been recording on the front surface of the preceding paper P1 by the recording portion 5, the transport roller pair 30 and the discharging roller pair 39 transport the preceding paper P1 in reverse to the upstream side in the transport direction at the time of recording and insert the paper P1 into the reverse path 51, and the first reverse roller pair 48 to the third reverse roller pair 50 retreat the paper P1 from the connection point B, which is opposite to the side where it was inserted into the reverse path 51, to the paper guide path 24 and transports the paper P1 to the recording portion; there is recording on the rear surface of the preceding paper P1 by the recording portion 5 while the transport roller pair 30 and the discharging roller pair 39 transport the preceding paper P1, and the discharging roller pair 39 transports the preceding paper P1 to the downstream side in the transport direction at the time of recording; the pickup roller 17 installed on the mounting portion 7 transports the succeeding paper P2 to the recording portion while guiding it to the paper guide path 24; after there has been recording on the front surface of the succeeding paper P2 by the recording portion 5 while the transport roller pair 30 and the discharging roller pair 39 transport the succeeding paper P2; the transport roller pair 30 and the discharging roller pair 39 transport the succeeding paper P2 in reverse to the upstream side in the transport direction at the time of recording and insert the paper P2 into the reverse path 51, and the first reverse roller pair 48 to the third reverse roller pair 50 retreat the paper P2 from the connection point B, which is opposite to the side where it was inserted into the reverse path 51, to the paper guide path 24 and transport the paper P2 to the recording portion.

In addition, in the embodiment, the recording portion 5 of the printer main body side has a structure that discharges the ink to record on the paper P and, when the amount of the ink discharged to the paper P is larger than the predetermined amount, the recording portion 5 is switched to the "transportation time reduction mode".

In addition, in the "transportation time reduction mode" of the embodiment, when one paper (e.g., the preceding paper) is inserted into the reverse path 51 from the paper guide path 24, the other paper (e.g., the succeeding paper) is transported at the timing when the front end side in the movement direction of the other paper (e.g., the succeeding paper) transported to the recording portion side overlaps with the rear end side in the movement direction of the one paper (e.g., the preceding paper) on the paper guide path.

The printer 1 as the recording apparatus of the embodiment includes the recording portion 5 for recording on the paper P and the reverse transporting portion 4 that has the transport path of the ring shape when seen from the side thereof and reverses the paper P to its front and rear sides between the mounting portion 7 and the recording portion 5.

The printer 1 of the embodiment includes the mounting portion 7 for mounting the paper P; the pickup roller 17 that is installed in the mounting portion 7 and serves as the roller for transporting the paper P to the downstream side in the transport direction at the time of recording; the transport roller pair 30 as the transport roller for transporting the paper P transported by the pickup roller 17 to the downstream side in the transport direction; the recording portion 5 for recording on the paper P transported by the transport roller pair 30; the discharging roller pair 39 as the discharging roller for transporting the paper P recorded by the recording portion 5 to the downstream side in the transport direction; the paper guide path 24 as the medium guide path for guiding the paper P between the mounting portion 7 and the recording portion 5; the reverse transporting portion 4 which has the reverse path 51 as the transport path that is connected to the paper guide path 24 and reverses the paper P to its front and rear sides between the pickup roller 17 and the transport roller pair 30 on the paper guide path and the reverse transporting portion 4 that is installed on the reverse path and has the first reverse roller pair 48 to the third reverse roller pair 50 as the unit for transporting the paper P; the sensor 8 which is installed between the transport roller pair 30 and the reverse transporting portion 4 on the paper guide path and is an example of the detection unit for detecting the paper P; the controlling portion 6 that controls the driving of the pickup roller 17, the transport roller pair 30, the discharging roller pair 39, and the first reverse roller pair 48 to the third reverse roller pair 50.

Furthermore, after the recording portion 5 records on the front surface of the preceding paper P1, according to the length of the paper P1, the controlling portion 6 has the first mode for controlling such that the reverse roller pair 30 and the discharging roller pair 39 are driven for reverse rotation to transport the preceding paper P1 in reverse to the upstream side in the transport direction at the time of recording and insert it into the reverse path 51, whereby the first reverse roller pair 48 to the third reverse roller pair 50 hold the preceding paper P1; the pickup roller 17 is driven for forward rotation to transport the succeeding paper P2 to the recording portion while guiding it to the paper guide path 24, and the reverse roller pair 30 and the discharging roller pair 39 are driven for forward rotation to record on the front surface of the succeeding paper P2 by the recording portion 5 while the succeeding paper P2 is transported; thereafter, when the reverse roller pair 30 and the discharging roller pair 39 are driven for rearward rotation to transport the succeeding paper P2 in reverse to the upstream side in the transport direction at the time of recording and insert it into the reverse path 51, the first reverse roller pair 48 to the third reverse roller pair 50 are driven to retreat the preceding paper P1 positioned in the reverse path 51 from the connection point B, which is opposite to the side where it was inserted into the reverse path 51, to the paper guide path 24 and transport it to the recording portion side, and while the reverse roller pair 30 and the discharging roller pair 39 are driven for forward rotation to transport the preceding paper P1, when the first surface of the preceding paper P1 is front surface, there is recording on the rear surface by the recording portion 5; subsequently, when the discharging roller pair 39 is driven for forward rotation to transport the preceding paper P1 to the downstream side in the transport direction at the time of recording, the first reverse roller pair 48 to the third reverse roller pair 50 are driven to retreat the succeeding paper P2 positioned in the reverse path 51 from the connection point B, which is opposite to the side where it was inserted into the reverse path 51, to the paper guide path 24 and transport it to the recording portion side, while the reverse roller pair 30 and the discharging roller pair 39 are driven for forward rotation to transport the succeeding paper P2, there is recording on the rear surface of the succeeding paper P2 by the recording portion 5.

Furthermore, while three roller pairs (48 to 50) as the unit for transporting have been installed in the reverse transporting portion 4 in the above-described embodiment, it is needless to say that the number thereof is not limited to three.

In addition, it is needless to say that the invention can be variously modified within the scope of the invention described in the claims, without being limited to the above-described embodiment, and those are also included within the scope of the invention.

What is claimed is:

1. A medium transporting apparatus which is mounted on a recording apparatus main body for recording with respect to a medium to be recorded comprising:

a transporting unit that is driven by a motor and transports the medium to be recorded in a transport direction; and a first transport path that has the transporting unit on a path and reverses the sides of the medium to be recorded when guiding the medium to be recorded which is transported by the transporting unit, wherein the first transport path is installed so as to be connected to the middle of a second transport path that guides the medium to be recorded between a mounting portion for mounting the medium to be recorded in the recording apparatus main body and a recording portion for recording with respect to the medium to be recorded, the medium transporting apparatus has a first mode in which after there has been recording on a first surface of a preceding medium to be recorded by the recording portion, according to the length of the medium to be recorded, in a state in which a first roller installed in the recording portion transports the preceding medium to be recorded in reverse to the upstream side in the transport direction at the time of recording and inserts it into the first transport path, and the transporting unit holds the preceding medium to be recorded, a second roller installed on the mounting portion transports a succeeding medium to be recorded to the recording portion side while guiding it to the second transport path, after there has been recording on a first surface of the succeeding medium to be recorded by the recording portion while the first roller transports the succeeding medium to be recorded, when the first roller transports the succeeding medium to be recorded in reverse to the upstream side in the transport direction at the time of recording and inserts it into the first transport path, the transporting unit retreats the preceding medium to be recorded, which is positioned in the first transport path, from a side which is opposite to the side where it was inserted into the first transport path, to the second transport path and transports it to the recording portion, after a second surface, which is a rear surface when there has been recording on the first surface of the preceding medium to be recorded is a front surface, by the recording portion, while the first roller transports the preceding medium to be recorded, when the first roller transports the preceding medium to be recorded to the downstream side in the transport direction at the time of recording, the transporting unit retreats the succeeding medium to be recorded, which is positioned in the first transport path, from the side which is opposite to the side where it was inserted into the first transport path, to the second transport path and transports it to the recording portion side.

2. The medium transporting apparatus according to claim 1, wherein:

the medium transporting apparatus has the first mode and a second mode in a switchable manner, in the second mode, after there has been recording on the first surface of the preceding medium to be recorded by the recording portion, the first roller transports the preceding medium to be recorded in reverse to the upstream side in the transport direction at the time of recording and inserts it into the first transport path, the transporting unit retreats the preceding medium to be recorded from a side, which is opposite to the side where it was inserted into the first transport path, to the second transport path and transports it to the recording portion side, there is recording on the second surface of the preceding medium to be recorded by the recording portion while the first roller transports the preceding medium to be recorded, and the first roller transports the preceding medium to be recorded to the downstream side in the transport direction at the time of recording, the second roller installed on the mounting portion transports the succeeding medium to be recorded to the recording portion, while guiding it to the second transport path, and after there has been recording on the first surface of the succeeding medium to be recorded by the recording portion while the first roller transports the succeeding medium to be recorded, the first roller transports the succeeding medium to be recorded in reverse to the upstream side in the transport direction at the time of recording and inserts it into the first transport path, and the transporting unit retreats the medium to be recorded from the side, which is opposite to the side where it was inserted into the first transport path, to the second transport path and transports it to the recording portion side.

3. The medium transporting apparatus according to claim 2, wherein the recording portion of the recording apparatus main body side has a structure that discharges ink to record on the medium to be recorded and, when the amount of the ink discharged to the medium to be recorded is larger than a predetermined amount, the recording portion is switched to the first mode.

4. The medium transporting apparatus according to claim 1, wherein in the first mode, when one medium to be recorded is inserted into the first transport path from the second transport path, the other medium to be recorded is transported at a timing when a front end side of the movement direction of another medium to be recorded, which is transported to the recording portion side, overlaps with a rear end side in the movement direction of the one medium to be recorded on the second transport path.

5. A recording apparatus comprising:

a recording portion for recording with respect to a transported medium to be recorded; and a reverse transporting portion that reverses the sides of the medium to be recorded, the reverse transporting portion having a medium transporting apparatus that is mounted on a main body of the recording apparatus and includes:

a transporting unit that is driven by a motor and transports the medium to be recorded in a transport direction; and a first transport path that has the transporting unit on a path and reverses the sides of the medium to be recorded when guiding the medium to be recorded which is transported by the transporting unit, wherein:

the first transport path is installed so as to be connected to the middle of a second transport path that guides the medium to be recorded between a mounting portion for mounting the medium to be recorded in the recording apparatus main body and a recording portion for recording with respect to the medium to be recorded, the medium transporting apparatus has a first mode in which after there has been recording on a first surface of a preceding medium to be recorded by the recording portion, according to the length of the medium to be recorded, in a state in which a first roller installed in the recording portion transports the preceding medium to be recorded in reverse to the upstream side in the transport direction at the time of recording and inserts it into the first transport path, and the transporting unit holds the preceding medium to be recorded, a second roller installed on the mounting portion transports a succeeding medium to be recorded to the recording portion side while guiding it to the second transport path, after there has been recording on a first surface of the succeeding medium to be recorded by the recording portion while the first roller transports the succeeding medium to be recorded, when the first roller transports the succeeding medium to be recorded in reverse to the upstream side in the transport direction at the time of recording and inserts it into the first transport path, the transporting unit retreats the preceding medium to be recorded, which is positioned in the first transport path, from a side which is opposite to the side where it was inserted into the first transport path, to the second transport path and transports it to the recording portion, and after a second surface, which is a rear surface when there has been recording on the first surface of the preceding medium to be recorded is a front surface, by the recording portion, while the first roller transports the preceding medium to be recorded, when the first roller transports the preceding medium to be recorded to the downstream side in the transport direction at the time of recording, the transporting unit retreats the succeeding medium to be recorded, which is positioned in the first transport path, from the side which is opposite to the side where it was inserted into the first transport path, to the second transport path and transports it to the recording portion side.

6. The recording apparatus according to claim 5, wherein:

the medium transporting apparatus has the first mode and a second mode in a switchable manner, in the second mode, after there has been recording on the first surface of the preceding medium to be recorded by the recording portion, the first roller transports the preceding medium to be recorded in reverse to the upstream side in the transport direction at the time of recording and inserts it into the first transport path, the transporting unit retreats the preceding medium to be recorded from a side, which is opposite to the side where it was inserted into the first transport path, to the second transport path and transports it to the recording portion side, there is recording on the second surface of the preceding medium to be recorded by the recording portion while the first roller transports the preceding medium to be recorded, and the first roller transports the preceding medium to be recorded to the downstream side in the transport direction at the time of recording, the second roller installed on the mounting portion transports the succeeding medium to be recorded to the recording portion, while guiding it to the second transport path, and after there has been recording on the first surface of the succeeding medium to be recorded by the recording portion while the first roller transports the succeeding medium to be recorded, the first roller transports the succeeding medium to be recorded in reverse to the upstream side in the transport direction at the time of recording and inserts it into the first transport path, and the transporting unit retreats the medium to be recorded from the side, which is opposite to the side where it was inserted into the first transport path, to the second transport path and transports it to the recording portion side.

7. The recording apparatus according to claim 6, wherein the recording portion of the recording apparatus main body side has a structure that discharges ink to record on the medium to be recorded and, when the amount of the ink discharged to the medium to be recorded is larger than a predetermined amount, the recording portion is switched to the first mode.

8. The recording apparatus according to claim 5, wherein in the first mode, when one medium to be recorded is inserted into the first transport path from the second transport path, the other medium to be recorded is transported at a timing when a front end side of the movement direction of another medium to be recorded, which is transported to the recording portion side, overlaps with a rear end side in the movement direction of the one medium to be recorded on the second transport path.

9. A recording apparatus comprising:

a mounting portion for mounting a medium to be recorded;

a pickup roller that is installed on the mounting portion and transports the medium to be recorded to a downstream side in a transport direction at the time of recording;

a transport roller for transporting the medium to be recorded, which has been transported by the roller, to the downstream side in the transport direction;

a recording portion for recording on the medium to be recorded which has been transported by the transport roller;

a discharging roller for transporting the medium to be recorded, which has been recorded on by the recording portion, to the downstream side in the transport direction;

a medium guide path for guiding the medium to be recorded between the mounting portion and the recording portion;

a reverse transporting portion which has the a transport path that is connected to the medium guide path and reverses the sides of the medium to be recorded between the roller and the transport roller on the medium guide path, and the reverse transporting portion that is installed on the transport path and has a transporting unit for transporting the medium to be recorded;

a detecting unit which is installed between the transport roller and the reverse transporting portion on the medium guide path and detects the medium to be recorded; and a controlling portion that controls the driving of the roller, the transport roller, the discharging roller and the first transporting unit, wherein, after the recording portion records a first surface of a preceding medium to be recorded, the controlling portion, according to the length of the medium to be recorded, has the first mode for controlling such that in a state in which the transport roller and the discharging roller are driven for reverse rotation to transport the preceding medium to be recorded in reverse to the upstream side in the transport direction at the time of recording and insert it into the transport path, whereby the transporting unit holds the preceding medium to be recorded, the roller is driven for forward rotation to transport a succeeding medium to be recorded to the recording portion while guiding it to the medium guide path, and while the transporting roller and the discharging roller are driven for forward rotation to transport the succeeding medium to be recorded, there is recording on the first surface of the succeeding medium to be recorded by the recording portion, then, when the transporting roller and the discharging roller are driven for rearward rotation to transport the succeeding medium to be recorded in reverse to the upstream side in the transport direction at the time of recording and insert it into the transport path, the transporting roller is driven to retreat the preceding medium to be recorded, which is positioned in the transport path, from a side, which is opposite to the side where it was inserted into the transport path, to the medium guide path and transport it to the recording portion, and while the transporting roller and the discharging roller are driven for forward rotation to transport the preceding medium to be recorded, there is recording on a second surface, which is a rear surface when the first surface of the preceding medium to be recorded is a front surface, by the recording portion, and subsequently, when the discharging roller is driven for forward rotation to transport the preceding medium to be recorded to the downstream side in the transport direction at the time of recording, the transporting roller is driven to retreat the succeeding medium to be recorded, which is positioned in the transport path, from the side, which is opposite to the side where it was inserted into the transport path, to the medium guide path and transport it to the recording portion, and while the transporting roller and the discharging roller are driven for forward rotation to transport the succeeding medium to be recorded, there is recording on the second surface of the succeeding medium to be recorded by the recording portion.

* * * * *